US011523672B2

(12) United States Patent
Bose et al.

(10) Patent No.: US 11,523,672 B2
(45) Date of Patent: Dec. 13, 2022

(54) COSMETIC APPLICATOR WITH FLEXIBLE FLUID RETAINING PORTION

(71) Applicant: Toly Management Ltd., Zejtun ZTN (MT)

(72) Inventors: Rahul Bose, New Dehli (IN); Dorien Bianco, Zejtun (MT)

(73) Assignee: Toly Management Ltd., Zejtun (MT)

( * ) Notice: Subject to any disclaimer, the term of this patent is extended or adjusted under 35 U.S.C. 154(b) by 107 days.

(21) Appl. No.: 16/848,173

(22) Filed: Apr. 14, 2020

(65) Prior Publication Data

US 2020/0323327 A1 Oct. 15, 2020

(30) Foreign Application Priority Data

| | | |
|---|---|---|
| Apr. 14, 2019 | (IN) | 201911014979 |
| Sep. 24, 2019 | (IN) | 201911038606 |
| Sep. 25, 2019 | (IN) | 201911038628 |
| Jan. 29, 2020 | (IN) | 202011003942 |

(51) Int. Cl.

| | |
|---|---|
| ***A45D 34/04*** | (2006.01) |
| ***A45D 33/00*** | (2006.01) |
| ***A45D 40/26*** | (2006.01) |
| ***A46B 9/02*** | (2006.01) |

(52) U.S. Cl.

CPC ..... *A45D 34/046* (2013.01); *A45D 33/00* (2013.01); *A45D 34/043* (2013.01); *A45D 40/267* (2013.01); *A46B 9/021* (2013.01); *A46B 2200/1046* (2013.01); *A46B 2200/1053* (2013.01)

(58) Field of Classification Search

CPC .... A45D 34/046; A45D 33/00; A45D 34/043; A45D 40/267; A46B 9/021; A46B 2200/1046; A46B 2200/1053

USPC ..... 132/318

See application file for complete search history.

(56) References Cited

U.S. PATENT DOCUMENTS

| | | | | |
|---|---|---|---|---|
| 1,113,843 A | | 10/1914 | Smith | |
| D149,899 S | | 6/1948 | Melnikoff | |
| 2,442,503 A | * | 6/1948 | Melnikoff | A45D 40/04 132/320 |
| 4,209,027 A | | 6/1980 | Morganroth | |
| 4,370,989 A | | 2/1983 | Taylor | |
| D311,258 S | | 10/1990 | Jankewitz | |
| 5,937,866 A | | 8/1999 | Maghareti | |
| 6,076,534 A | | 6/2000 | Gueret | |

(Continued)

FOREIGN PATENT DOCUMENTS

| | | |
|---|---|---|
| CN | 103732100 | 4/2014 |
| CN | 105120710 | 12/2015 |

(Continued)

*Primary Examiner* — Jacqueline T Johanas
*Assistant Examiner* — Holly T. To
(74) *Attorney, Agent, or Firm* — Wissing Miller LLP

(57) ABSTRACT

A cosmetic package for applying a composition including a cosmetic, care or pharmaceutical composition onto the keratinous substrate comprises a receptacle and a cosmetic applicator. The cosmetic applicator further comprises an applicator head, a stem and a closure. The applicator head includes an applying member which comprises a spatula with a first application face having a concave inner surface and a second application face having a convex outer surface.

12 Claims, 23 Drawing Sheets

(56) References Cited

U.S. PATENT DOCUMENTS

| | | | | |
|---|---|---|---|---|
| 6,129,469 | A | 10/2000 | Messer | |
| 6,220,254 | B1 | 4/2001 | Gueret | |
| 6,227,737 | B1 | 5/2001 | Lightfoot | |
| 6,302,607 | B1 | 10/2001 | Burrowes | |
| 6,331,085 | B1 | 12/2001 | Schrepf et al. | |
| 6,371,130 | B1 * | 4/2002 | Vasas | A46B 9/021 132/218 |
| 6,508,256 | B2 | 1/2003 | Byun | |
| 6,526,987 | B1 | 3/2003 | Giola | |
| 6,616,366 | B1 | 9/2003 | Weihrauch | |
| 6,675,814 | B2 | 1/2004 | Gueret | |
| D527,143 | S * | 8/2006 | Fischer | D28/7 |
| 7,134,799 | B2 | 11/2006 | Gueret | |
| D537,200 | S | 2/2007 | Montoli | |
| D538,975 | S | 3/2007 | Montoli | |
| D544,644 | S * | 6/2007 | Hartstock | D28/7 |
| 7,481,591 | B2 * | 1/2009 | Dumler | A45D 40/265 401/126 |
| D586,048 | S * | 2/2009 | Hartstock | D28/7 |
| D591,904 | S * | 5/2009 | Mongeon | D28/7 |
| 7,677,826 | B2 | 3/2010 | Gueret | |
| D614,347 | S * | 4/2010 | Uehara | D28/7 |
| D617,045 | S | 6/2010 | Uehara et al. | |
| D633,650 | S | 3/2011 | Uehara et al. | |
| D638,987 | S * | 5/2011 | Limongi | D28/7 |
| D638,991 | S * | 5/2011 | Limongi | D28/7 |
| D640,000 | S * | 6/2011 | Limongi | D28/7 |
| D640,001 | S * | 6/2011 | Limongi | D28/7 |
| D641,929 | S | 7/2011 | Poletto | |
| 8,191,559 | B2 * | 6/2012 | Bickford | A45D 34/045 132/218 |
| D685,948 | S * | 7/2013 | Pires | D28/7 |
| 8,834,052 | B2 * | 9/2014 | Kim | A45D 40/26 401/126 |
| D729,977 | S * | 5/2015 | Pires | D28/7 |
| 9,247,805 | B1 | 2/2016 | Malm | |
| 9,468,280 | B2 | 10/2016 | Uehara et al. | |
| D807,580 | S * | 1/2018 | Nagata | D28/7 |
| 9,936,790 | B2 | 4/2018 | Pires et al. | |
| D826,472 | S | 8/2018 | Pires et al. | |
| 10,285,494 | B1 | 5/2019 | Lho | |
| 10,349,722 | B2 | 7/2019 | Yasumi | |
| 10,517,370 | B2 | 12/2019 | Caulier et al. | |
| 10,575,621 | B1 * | 3/2020 | Pires | A45D 40/265 |
| D898,995 | S * | 10/2020 | Jung | D28/7 |
| 10,881,183 | B2 * | 1/2021 | Balestrini | A45D 34/043 |
| 11,154,126 | B1 | 10/2021 | Zheng | |
| 11,185,145 | B1 * | 11/2021 | Zheng | A45D 33/00 |
| 2003/0172950 | A1 * | 9/2003 | Bouix | A45D 40/265 132/318 |
| 2004/0161285 | A1 * | 8/2004 | Gueret | A45D 34/04 401/130 |
| 2005/0072442 | A1 | 4/2005 | Licari | |
| 2005/0109365 | A1 * | 5/2005 | Dunton | A45D 34/045 132/320 |
| 2006/0013639 | A1 * | 1/2006 | Gueret | A45D 34/045 401/130 |
| 2007/0020027 | A1 * | 1/2007 | Gueret | A45D 40/262 401/130 |
| 2007/0110500 | A1 * | 5/2007 | Cochran | A45D 34/046 401/122 |
| 2007/0186951 | A1 | 8/2007 | Gueret | |
| 2007/0201939 | A1 | 8/2007 | Wong | |
| 2007/0272269 | A1 | 11/2007 | Wyatt | |
| 2008/0196735 | A1 | 8/2008 | Wyatt | |
| 2010/0018676 | A1 | 1/2010 | Spagnuolo | |
| 2013/0017010 | A1 | 1/2013 | Liu | |
| 2013/0276817 | A1 * | 10/2013 | Holloway | A45D 40/26 132/320 |
| 2014/0216495 | A1 | 8/2014 | Bureiko | |
| 2015/0320176 | A1 * | 11/2015 | Pires | A45D 40/265 401/126 |
| 2015/0374099 | A1 * | 12/2015 | Pires | A61M 35/006 401/130 |
| 2016/0157586 | A1 * | 6/2016 | Pires | A45D 40/265 401/129 |
| 2016/0270514 | A1 * | 9/2016 | Pires | A45D 40/265 |
| 2016/0331100 | A1 | 11/2016 | Canestrini | |
| 2017/0071315 | A1 * | 3/2017 | Pires | A45D 34/04 |
| 2017/0231365 | A1 | 8/2017 | Choi | |
| 2017/0265624 | A1 | 9/2017 | Wilson | |
| 2018/0020807 | A1 | 1/2018 | Villarreal | |
| 2018/0177281 | A1 | 6/2018 | Pires | |
| 2018/0279740 | A1 * | 10/2018 | Kukreja | A45D 34/046 |
| 2019/0000222 | A1 | 1/2019 | Balestrini et al. | |
| 2019/0008260 | A1 | 1/2019 | Wilson | |
| 2019/0357665 | A1 | 11/2019 | Booker | |
| 2020/0069031 | A1 * | 3/2020 | Gabon | A45D 34/046 |
| 2020/0138182 | A1 | 5/2020 | Busch | |
| 2021/0315361 | A1 | 10/2021 | Zheng | |
| 2022/0022628 | A1 | 1/2022 | Jurkouich | |

FOREIGN PATENT DOCUMENTS

| | | | | |
|---|---|---|---|---|
| DE | 102011089611 | | 6/2012 | |
| DE | 102011054507 | | 4/2013 | |
| DE | 202013010463 | | 2/2015 | |
| DE | 202017100439 | | 2/2017 | |
| DE | 202016105240 | | 12/2017 | |
| DE | 202019005638 | | 4/2021 | |
| EP | 1070467 | | 1/2001 | |
| EP | 1070468 | | 1/2001 | |
| EP | 1080659 | A2 * | 3/2001 | A45D 34/046 |
| EP | 1649777 | | 4/2006 | |
| EP | 1745717 | | 1/2007 | |
| EP | 1745717 | A2 * | 1/2007 | A45D 40/267 |
| EP | 1745717 | | 6/2010 | |
| EP | 2952118 | | 12/2015 | |
| EP | 3219224 | | 9/2017 | |
| EP | 3300624 | A1 * | 4/2018 | A45D 40/265 |
| EP | 2875750 | | 3/2019 | |
| EP | 3530144 | | 8/2019 | |
| EP | 3300624 | | 12/2019 | |
| EP | 3302167 | | 6/2020 | |
| FR | 2762494 | | 10/1998 | |
| FR | 2926446 | | 7/2009 | |
| FR | 2971923 | A1 * | 8/2012 | A45D 40/265 |
| FR | 2976464 | | 12/2012 | |
| FR | 3013194 | | 5/2015 | |
| FR | 3023458 | | 1/2016 | |
| FR | 3106478 | | 7/2021 | |
| GB | 2237036 | | 4/1991 | |
| JP | 2004065467 | | 3/2004 | |
| JP | 5716056 | | 5/2015 | |
| KR | 100874220 | | 12/2008 | |
| KR | 20110000930 | | 1/2011 | |
| KR | 101242196 | | 3/2013 | |
| KR | 20140130794 | | 11/2014 | |
| KR | 20150011357 | | 1/2015 | |
| KR | 20170011603 | A * | 2/2017 | |
| KR | 102303475 | | 9/2021 | |
| KR | 20210110544 | | 9/2021 | |
| KR | 102318862 | | 10/2021 | |
| KR | 20210129436 | | 10/2021 | |
| PL | 1839523 | | 12/2008 | |
| WO | WO-2011043470 | A1 * | 4/2011 | A45D 34/042 |
| WO | 2012140161 | | 10/2012 | |
| WO | WO-2013080352 | A1 * | 6/2013 | A45D 34/042 |
| WO | WO-2014154749 | A1 * | 10/2014 | A45D 40/261 |
| WO | 2016042216 | | 3/2016 | |
| WO | WO-2016051072 | A1 * | 4/2016 | A46B 9/021 |
| WO | 2017146373 | | 8/2017 | |
| WO | 2017182355 | | 10/2017 | |
| WO | WO-2018109023 | A1 * | 6/2018 | A46B 1/00 |
| WO | 2018/217003 | | 11/2018 | |
| WO | WO-2018217003 | A1 * | 11/2018 | A45D 34/04 |
| WO | 2019083325 | | 5/2019 | |
| WO | 2020/032308 | | 2/2020 | |
| WO | 2020/032309 | | 2/2020 | |
| WO | 2010042878 | | 4/2020 | |

* cited by examiner

COSMETIC APPLICATOR WITH FLEXIBLE FLUID RETAINING PORTION

This application claims priority under 35 U.S.C. § 119 to Indian Provisional Patent Application No. 201911014979, filed on Apr. 14, 2019; Indian Provisional Patent Application No. 201911038606, filed on Sep. 24, 2019; Indian Provisional Patent Application No. 201911038628, filed on Sep. 25, 2019; and Indian Provisional Patent Application No. 202011003942, filed on Jan. 29, 2020. The disclosure of each of these applications is incorporated herein by reference.

BACKGROUND

Field

The present disclosure relates generally relates to a cosmetic applicator for applying a product including a cosmetic, care or pharmaceutical product, onto keratinous substrate such as skin, lips, under eyes, eyebrows, eyelids, cheeks, nails or any other part of the body. In particular, the disclosure relates to an applicator for cosmetic products that provides a cavity for carrying a quantity of the product from a container for application onto the keratinous surface.

Description of the Related Art

Devices exist for dispensing cosmetic or medicinal products. Such devices usually consist of a container carrying cosmetic or medicinal products, a delivery mechanism for displacement of the cosmetic or medicinal products, and an applicator. For example, in the medical industry, applicators are employed for applying medicinal products, such as ointments, to portions of the body. In the cosmetics and personal care industries, applicators are used to apply lipstick, lip balm, skin creams, lotions, and other cosmetic products to portions of the body.

Many cosmetic products that are flowable or otherwise non-self-sustaining in shape, are packaged and sold in a container which hold the cosmetic product and from which the cosmetic product is transported and applied to a user's skin by a cosmetic applicator.

Commonly, the cosmetic applicator is provided at the end of a stem carried by a cap which seats on and closes the mouth or opening of the container, the cosmetic applicator being immersed in the cosmetic material contained in the container when the cap is in the container-closing position. The cap serves as a handle for the user when the cosmetic applicator, bearing a quantity of the cosmetic product, is withdrawn from the container and applied to the skin.

In some instances, a flexible elastomeric wiper is mounted in the container opening so as to engage the cosmetic applicator as the cosmetic applicator is withdrawn through the opening, for removing excess cosmetic product that may be carried by the cosmetic applicator from the body of cosmetic product within the container.

The applicator may be immersed in the container containing the cosmetic material and then removed from the jar to apply the product to a user's skin. Such applicators may retain the cosmetic product by adhesion to the applicator surface. This limits the amount of product that can be delivered each time the applicator is immersed and removed from the jar. This may require the applicator to be repeatedly immersed several times in a row in order to deliver a sufficient quantity of product to carry out an entire application process. Thus, many prior art cosmetic applicators do not provide a location or area in which larger volumes of cosmetic material can be retained within or on the applicator head. With limited surface area and no location or area for retaining larger volumes of cosmetic material, many prior art applicators are consequently unable to permit fewer insertions of the cosmetic applicator head into the container for an application process, for example, covering lips with a lip gloss cosmetic.

Other conventional applicators include an internally supplied applicator where a quantity of a cosmetic product is stored in a container in fluid connection with the applicator head. Product is delivered to the applicator head from the reservoir as the application is performed. The product may be delivered, for example, by exerting pressure on the reservoir to squeeze the product onto the applicator head. In this way, the applicator head can be recharged without having to put the applicator down and dip it into the cosmetic container again. Providing a reservoir in fluid connection with the applicator, however, may add complexity and cost. In addition, it may be difficult for the user to control the amount of product delivered to the applicator head. Moreover, the amount of material held in the container in fluid connection with the applicator head may be limited by the dimensions of the applicator itself.

Thus, there still exists a need for a cosmetic package having an applicator with which a larger amount of product can be applied without having to re-dip the applicator into the cosmetic container.

SUMMARY

The present disclosure provides embodiments of a cosmetic package that can be easily configured to contain a product and a cosmetic applicator.

The present disclosure provides embodiments of a cosmetic package having a cosmetic applicator with which a larger amount of a cosmetic product can be applied without having to dip the cosmetic applicator into the cosmetic container occasionally.

The present disclosure provides embodiments of an applicator which offers a comparatively large surface area, very simple to use, economic to manufacture and aesthetically pleasing.

The present disclosure provides embodiments of a combined cosmetics package that comprises separable components that fit securely together so as to make a unitary package.

The present disclosure provides embodiments of a cosmetic applicator that is comfortable and easy to use.

Accordingly, there is provided a cosmetic package comprising a receptacle and the cosmetic applicator. The receptacle is configured to contain a product including a cosmetic, care or pharmaceutical product. In alternate embodiments, the receptacle may include a separate inner reservoir to hold a volume of the product to be dispensed. The cosmetic, care or pharmaceutical product includes viscous cosmetics, mascara, eyebrow powder, lip gloss, hair color, cheek blush, skin care, under eye cosmetics, pharmaceutical and like products.

According to an embodiment, the cosmetic package is of an elongated cylindrical configuration. In alternate embodiments, the cosmetic package may be of an elongated square, polygonal configuration, oval, triangular, heart, or any other configuration known in the art.

According to an embodiment, the cosmetic applicator comprises an applicator head, a stem and a closure or cap. The closure of the cosmetic package has threads on its inner surface which can be screwed onto threads, formed on an outer surface of a neck of the receptacle. In alternate embodiments, the closure may snap into place on the neck of the receptacle or any other type of mechanisms may be used to mate the closure to the receptacle.

A wiper is provided inside the neck of the container for wiping off excess cosmetic product from the cosmetic applicator. According to one embodiment, the wiper comprises an annular bead on its outer surface for engaging into a corresponding annular groove formed on an inside surface of the neck of the receptacle. The wiper comprises a wiping orifice sized to engage with the applicator.

According to an embodiment, the receptacle and the closure may be made of a rigid material like glass, metal, hard plastic or any other material known in the art. In alternate embodiments, the receptacle and the closure are made of a flexible material, for example, a flexible polymeric material or any other material known in the art.

According to an embodiment of the present disclosure, the applicator head and the stem are fitted together by a snap fitment. In alternate embodiments, the applicator head and the stem are fit together by friction fit, by gluing, crimping, magnetic engagement and the like. According to some embodiments, the distal end of the stem includes an interior longitudinal cavity for receiving and retaining the applicator head. The applicator head comprises said applying member at its distal portion and a shank member at its proximal portion. The shank member is configured to be received and retained within the interior longitudinal cavity of the stem.

According to an embodiment of the present disclosure, the stem can have a longitudinal axis that is rectilinear. In alternate embodiments, the stem is curved.

According to an embodiment of the present disclosure, the stem presents a cross-section that is circular. According to other embodiments the cross-section of the stem is another shape including oval, elliptical or polygonal, e.g. square, triangular or rectangular. The stem can be solid as shown, or, in a variant, it could be hollow.

When the stem is not of circular cross-section, the closure may be fastened on the receptacle by snap-fastening or by some other means, without turning relative to said receptacle. According to these embodiments, the wiper may have a non-circular wiper orifice that is complementary to the cross-section of the stem.

According to an embodiment of the present disclosure, the applicator head is made, at least in part, from a material that is more flexible than a material from which the stem is made.

According to an embodiment of the present disclosure, at least a part and preferably all of the applicator head can be made by molding, e.g. by injection-molding. The applicator head may be formed from materials suitable for injection molding, including thermoplastic materials; elastomers; thermoplastic elastomers; thermoplastic elastomer polyester such as HYTREL®; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP), and the like.

According to an embodiment of the present disclosure, the applicator head comprises the applying member and a shank portion. The shank portion is retained at a distal end of the stem for applying the cosmetic product. A closure shaped to close the cosmetic container is retained at a proximal end of the stem. The distal end of the stem includes an interior longitudinal cavity for receiving and retaining the shank of the applicator head.

According to an embodiment, the applying member is preferably formed from a thermoplastic urethane. According to a more preferred embodiment, the urethane is Desmopan® 487. In alternate embodiments, the applying member is formed from a suitable polymeric material or other material known in the art.

According to an embodiment of the present disclosure, an outer surface of the applying member is covered with an application element comprised of flocked fibers. Fibers for flocking may be any suitable material known in the art including nylon, polyester or a natural fiber. Flocking fibers may be applied with an adhesive, such as an epoxy, to the surface to be flocked. The flocking finish to the outer surface of the applying member may be achieved by an appropriately chosen known technique, such as electrostatic flocking. According to one embodiment, the outer surface of the applying member before being flocked is smooth and has no surface texture, that is, has no wrinkle finish or matte finish. To put it another way, the outer surface of the applying member before being flocked, according to some embodiments is smooth and slippery.

Preferably, the flocking process takes place in an electrostatic field, which results in the proper orientation of the fibers. The flock on the outer surface of the applying member provides a layer which can hold a small amount of the cosmetic product adequate for one or two applications. In alternate embodiments, the outer of the applying member may include injection molded fibers, projections or grooves which are capable of holding the cosmetic product.

According to an embodiment of the present disclosure, the outer surface of the applying member is covered by a flock coating. However, in alternate embodiments, the outer surface of the applying member is not covered by a flock coating.

According to an embodiment of the present disclosure, the applying member includes a root portion that is cylindrical in shape. According to alternate embodiments, the root portion is circular or any other shape known in the art.

According to an embodiment of the present disclosure, the applicator head can be made, at least in part, from a material that is more flexible than a material from which the stem is made. According to an embodiment, the receptacle and the cap may be made of a rigid material like glass, metal, hard plastic or any other material known in the art. However, in alternate embodiments, the receptacle and the cap may be made of a flexible material like flexible polymeric material or any other material known in the art.

According to a first embodiment of the disclosure there is provided a cosmetic applicator comprising an applying member, the applying member further comprises a root portion and a spatula extending from the root portion. The spatula extends from the root portion and has an elongated support body extending along the longitudinal axis of the cosmetic applicator. The spatula has a first application face and a second application face opposite to the first application face. The first application face has a concave inner surface while the second application face has a convex outer surface. The concave inner surface creates a volume reservoir. The convex outer surface acts a large blending surface for an easy application of the cosmetic product. Further, the spatula has a first longitudinal edge and a second longitudinal edge. At least one of the first longitudinal edge or the second longitudinal edge extends in all three dimensions of space.

According to an embodiment of the present disclosure, the volume reservoir of the concave inner surface of the first application face serves as a reservoir for the cosmetic product. A significant quantity of the cosmetic product can be accommodated in said volume reservoir which is available to be applied to the user's skin or keratinous substrate.

According to an embodiment of the present disclosure, the first longitudinal edge and the second longitudinal edge of the spatula are asymmetrical with respect to each other. At least one of the first longitudinal edge or the second longitudinal edge extends in all three dimensions of space. In a preferred embodiment, both the first longitudinal edge and the second longitudinal edge extend in all three dimensions of space. In a preferred embodiment, the first longitudinal edge comprises a first curve that is outwardly convex and a second curve that is outwardly concave. When seen from a proximal end to a distal end of the spatula, the first curve is followed by the second curve of the first longitudinal edge.

According to an embodiment of the present disclosure, the first and second curves of the first longitudinal edge differ from one another by the nature of their curves or by their radius of curvatures. According to the disclosure, when the curve does not correspond to a circular arc, the "radius of curvature is measured at the apex of the curve". The first curve is produced about a first axis of curvature to a first radius of curvature. The second curve is produced about a second axis of curvature to a second radius of curvature. According to a preferred embodiment, the first axis of curvature and the second axis of curvature are non-parallel and extend in different directions. The first radius of curvature may or may not be same as second radius of curvature. In a preferred embodiment, the first radius of curvature is greater than the second radius of curvature such that the first curve extends up to at least 75% of a length of the first longitudinal edge.

According to an embodiment of the present disclosure, the second longitudinal edge comprises a third curve that is outwardly convex, a fourth curve that is outwardly concave, and a fifth curve that is outwardly convex. When seen from the proximal end to the distal end of the spatula, the third curve is followed by the fourth curve and the fourth curve is followed by the fifth curve.

The third, fourth, fifth curves differ from one another by the nature of their curves or by their radius of curvatures. The third curve is produced about a third axis of curvature to a third radius of curvature. The fourth curve is produced about a fourth axis of curvature to a fourth radius of curvature. The fifth curve is produced about a fifth axis of curvature to a fifth radius of curvature.

According to an embodiment of the present disclosure, the third, fourth, fifth axis of curvatures is non-parallel and extends in different directions. The radius of curvatures of third, fourth, fifth may or may not be same. Particularly, the third radius of curvature and the fourth radius of curvature may or may not be equal. In the exemplary embodiment, the fifth radius of curvature is less than the third and the fourth radius of curvature. More particularly, at least one of the third curve or the fourth curve extends up to at least 30% of a length of the second longitudinal edge. The fifth curve extends up to at least 10% of a length of the second longitudinal edge.

According to an embodiment of the present disclosure, the first application face has a recess which is substantially enclosed by the first longitudinal edge and the second longitudinal edge except at the proximal end of the spatula. A gap is present between the first longitudinal edge and the second longitudinal edge, near the proximal end of the spatula. The recess promotes retention of the cosmetic product. When the cosmetic applicator is applied to keratinous substrate, the cosmetic product present in the recess can be deposited and the surface of cosmetic product coming into contact with the lips or any other part of the body may be relatively large, so that the lips or any other part of the body can be masked relatively quickly. The recess extends longitudinally from the proximal end to the distal end of the spatula.

According to an embodiment of the present disclosure, the recess extends along a longitudinal axis which does not coincide with the longitudinal axis of the cosmetic applicator. More particularly, the recess is off-centered with respect to the longitudinal axis of the cosmetic applicator and makes a non-zero angle with longitudinal axis of the cosmetic applicator.

According to an embodiment of the present disclosure, the recess is open to the outside throughout the length of the spatula via the first application face for use in applying the cosmetic product.

According to a preferred embodiment, the recess extends over more than half of the width of the spatula seen at any point along the longitudinal axis. In alternate embodiments, the recess does not extend over more than half of the width of the spatula.

According to an embodiment of the present disclosure, the width of the recess passes through an extremum between the proximal end and the distal end of the spatula. The extremum being, for example, a maximum. More particularly, when viewed from the front, the recess has a widest part which gradually decreases in width from the widest part to either the proximal end or the distal end of the spatula.

According to a preferred embodiment, the recess may be traversing over more than half the length of the spatula. In alternate embodiments, the recess does not traverse over more than half the length of the spatula.

According to an embodiment of the present disclosure, the first longitudinal edge and the second longitudinal edge converge to form a narrow tip at the distal end of the spatula. The narrow tip helps in precise deposition of the cosmetic product on applying the cosmetic product on the user's skin or keratinous substrate.

Further, according to one embodiment the narrow tip does not coincide with the longitudinal axis of the cosmetic applicator. More particularly, the narrow tip is off-centered with respect to the longitudinal axis of the cosmetic applicator.

According to an embodiment of the present disclosure, at the time of use of said cosmetic package, the user first separates the closure from the receptacle. In order to apply the product onto the keratinous substrate such as skin, lips, eyelids, cheeks, nails or any other part of the body, the cosmetic applicator is dipped into the product in the receptacle and then can be applied by the applicator head.

According to an embodiment of the present disclosure, upon withdrawing the cosmetic applicator from the state of being immersed in the cosmetic product, the cosmetic product is picked up and retained on the entire surface of the spatula.

According to an embodiment of the present disclosure, the widest part of the spatula has a larger width than the widest part of the wiper orifice. Accordingly, when the cosmetic applicator is withdrawn from the receptacle, the widest part of the spatula catches in the wiper orifice of the wiper. Since the spatula is made of an elastically deformable material in the present embodiment, it is deformed at the widest part catching in the wiper orifice so as to be able to pass through the wiper orifice.

Since the first application face of the spatula, where most of the cosmetic is retained, has the concave inner surface, the spatula is curled into a substantial C-shape with the first longitudinal edge and the second longitudinal edge approaching towards each other. Since the spatula is curled into the substantially C-shape, the cosmetic product remains retained inside the C-shape while the spatula is in a deformed state. On the other hand, the second application face has the convex outer surface and is wiped by the wiper. The second application face is deprived of the cosmetic product and acts as a blending surface for easy application of the cosmetic product which is applied by the first application face of the spatula.

The wiper is made of an elastically deformable material, so that both the spatula and the wiper orifice are deformed to reduce the resistance against the withdrawal and insertion, whereby the convenience of use is further improved.

After the spatula passes through the wiper orifice, it restores the original shape with no force by the wiper orifice imposed thereto. Accordingly, as the original shape is restored, the cosmetic product is spread over the entire area of the first application face of the spatula. As a result, the spatula is able to apply the cosmetic product uniformly to the lips or any other part of the body. At this time, there is very little retention of the cosmetic product on the second application face of the spatula, so that a user can apply the cosmetic product quickly at ease without feeling worried about unintentional application to other than the target region.

The wiper serves to wipe off not only the excess cosmetic product attached to the spatula but also the cosmetic product attached to the stem.

According to a second embodiment of the present disclosure, the cosmetic applicator comprises an applying member which includes a support body and a wing extending from the support body, wherein the wing is curved about a horizontal axis Y. The support body supports the wing at a base portion and at one lateral edge of the wing. The wing includes a concave front face and an opposite convex back face. Further, the wing is curved about the horizontal axis which is perpendicular to a longitudinal axis X of the applying member i.e. the wing is curved from left to right such that the wing defines a longitudinal concavity at the concave front face of the wing.

According to yet another aspect of the present disclosure, there is provided a cosmetic package comprises a receptacle for holding a cosmetic product and the cosmetic applicator. The cosmetic applicator comprises an applicator head, a stem, and a cap. The cap of the cosmetic applicator has threads which can be screwed onto threads, formed on a neck of the receptacle. The applicator head is retained at a distal end of the stem for applying the product; and the cap at a proximal end of the stem.

In general, the use of the terms “distal” and “proximal” herein is supposed to mean that the distal side/end is the side/end facing towards the inside of the storage receptacle, whereas the proximal side/end is the side or end facing towards the removal opening of the receptacle.

Further, the distal end of the stem includes an interior longitudinal cavity for receiving and retaining the applicator head. Further, in the neck of the receptacle a wiper is inserted for wiping off excess product from the cosmetic applicator.

Furthermore, the applicator head of cosmetic applicator may be used to apply the product including a cosmetic or care product. The cosmetic or care product includes viscous cosmetics, mascara, eyebrow powder, lip gloss, hair color, skin care, under eye cosmetics, pharmaceutical and like products.

The applicator head comprises said applying member at its distal portion and a shank member at its proximal portion. The shank member is configured to be received and retained within the interior longitudinal cavity of the stem.

According to an embodiment of the present disclosure, the support body extends in the stem’s longitudinal axis in the direction of the wing. The wing extends from a laterally from of the support body such that the support body supports the wing laterally on both the faces of the wing and at the base portion of the wing.

According to yet another embodiment of the present disclosure, the convex back face of the wing provides a large blending surface for smooth and efficient application of the cosmetic product. The applying member picks up generous amount of product in the concave front face of the wing so no re-dips are required during application. More particularly, the longitudinal concavity of the concave front face of the wing promotes retention of the cosmetic product. When the cosmetic applicator is applied to keratinous substrate, the cosmetic product present in the longitudinal concavity of the wing can be deposited and the surface of cosmetic product coming into contact with the lips or any other part of the body may be relatively large, so that the lips or any other part of the body can be masked relatively quickly.

According to an aspect of the present disclosure, the longitudinal concavity of the wing extends longitudinally from a proximal end to the distal end of the wing, along a longitudinal axis which does not coincide with the longitudinal axis X of the applying member/stem. More particularly, the longitudinal concavity is off-centered with respect to the longitudinal axis X of the applying member and makes a non-zero angle with longitudinal axis of the applying member.

According to an aspect of the present disclosure, the support body includes two opposing main faces, namely a first front face, an opposing second back face, and two opposing lateral faces namely a third lateral face and a fourth lateral face. The third lateral face is convexly curved along longitudinal axis X as well as along an axis Z which is substantially perpendicular to the X and Y axes. Further, the fourth lateral face comprises a convex curve followed by a concave curve when seen from the proximal portion towards the distal portion of the applying member. The wing extends laterally from the said fourth lateral face of the support body. A joining edge of the wing connects along at least a part of the convexly curved and the concavely curved surface of the fourth lateral face of the support body.

In alternate embodiments, the curves of the third and fourth lateral faces of the support body or the shape of the support body may be different, and thus the disclosure is not limited by the curves of the third and fourth lateral faces of the support body or the shape of the support body.

According to an embodiment of the present disclosure, a width the first front face and the second back face of the support body decrease continuously from a proximal end of the applying member toward the distal portion of the applying member, when seen from a front view and a back view of the applying member.

Further, the width of the third lateral face of the support body, when seen from the left side view of the applying member, decreases continuously from a proximal end of the applying member towards a distal portion of the applying member. More particularly, the support body in a left side view of the applying member, has a shape which towards the tip of the applying member is convexly curved and has sloping side edges. The third lateral face of the support body provides a narrow blending surface to line and blend a cosmetic product for example at corners of lip and eyes.

According to yet another embodiment of the present disclosure, the applying member is made of an elastomer, in particular of a thermoplastic elastomer. The wing is relatively thinner than the support body. More particularly, the wing is at least 2, 3 times thinner than the support body. As a reason, the wing is more flexible and elastically bendable, in particular relative to the support body. The wing is flexible enough to flex during application along contours of the human facial skin or lips so as to provide an even coating of the cosmetic product.

A swirl shaped extension extends from the support body to the concave front face of the wing which provides a strength to the wing during application. However, the swirl shaped extension is an optional feature, the applying member may or may not comprise any such extensions.

According to yet another embodiment of the present disclosure, width of the wing first increases from a proximal end of the wing and forms a widest part of the wing and then gradually decreases from the widest part to a distal end of the wing. A narrow tip is formed at the distal end of the wing which coincides with a distal end of the applying member. Further, the narrow tip at the distal end allows the user to draw precision lines during application. Further, the narrow tip at the distal end of the applying member may not coincide with the longitudinal axis X of the applying member. More particularly, the narrow tip is off-centered with respect to the longitudinal axis X of the cosmetic applicator.

According to yet another embodiment of the present disclosure, the widest part of the applying member coincides with the widest part of the wing.

According to an embodiment of the present disclosure, at least one of the wing and support body may be flocked.

According to an alternate embodiment of the present disclosure, the applying member may not be flocked.

According to a preferred embodiment of the present disclosure, an outer surface of the applying member is covered with application element which in this case is flocked fibers. Briefly, the fibers for flocking which may be of any commonly used material, such as nylon, polyester or any natural fiber are applied with an adhesive, such as an epoxy, to the surface to be flocked. The flocking finish to the outer surface of the applying member may be achieved by an appropriately chosen known technique, such as electrostatic flocking.

At the time of use of said cosmetic package, the user first separates the cap from the receptacle. In order to apply the cosmetic product onto the keratinous substrate such as skin, lips, eyelids, cheeks, nails or any other part of the body, the cosmetic applicator is dipped into the cosmetic product in the receptacle and then can be applied by the applicator head.

Upon withdrawing the cosmetic applicator from the state of being immersed in the cosmetic product, the cosmetic product is picked up and retained on the entire surface of the wing and the support body.

The widest part of the applying member has a larger width than the widest part of the wiper orifice. Accordingly, when the cosmetic applicator is withdrawn from the receptacle, the widest part of the applying member catches in the wiper orifice of the wiper. Since, the wing is made of an elastically deformable material in the present embodiment, it is deformed at the widest part catching in the wiper orifice so as to be able to pass through the wiper orifice. A free lateral edge substantially opposite to the joining edge of the wing that joins the wing to the support body, deform to curl inwardly towards the concave front face of the wing, where most of the cosmetic is retained. Since the wing is curled, the cosmetic product is retained inside the longitudinal concavity of the wing while the wing is in a deformed state. On the other hand, the convex back surface of the wing and the first surface of the support body is wiped more by the wiper and acts as a blending surface for easy application of the cosmetic product which is applied by the concave front face of the wing.

According to one embodiment, the wiper is made of an elastically deformable material, so that both the wing and the wiper orifice are deformed to reduce the resistance against the withdrawal and insertion, whereby the convenience of use is further improved.

After the wing passes through the wiper orifice, it restores the original shape with no force by the wiper orifice imposed thereto. Accordingly, as the original shape is restored, the cosmetic product is spread over the entire area of the concave front face of the wing. As a result, the wing is able to apply the cosmetic product uniformly to the lips or any other part of the body. At this time, there is a very little retention of the cosmetic product on the convex back face of the wing, so that a user can apply the cosmetic product quickly at ease without feeling worried about unintentional application to other than the target region.

The wiper serves to wipe off not only the excess cosmetic product attached to the wing but also the cosmetic product attached to the stem.

According to an embodiment of the present disclosure, at least a part and preferably all of the applicator head can be made by molding, e.g. by injection-molding. The applicator head can be formed by materials known to those in the art as suitable for injection molding including thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP), and the like.

According to an embodiment of the present disclosure, the stem presents a cross-section that is circular. According to other embodiments the cross-section of the stem is oval, elliptical or polygonal, e.g. square, triangular or rectangular. The stem can be solid as shown, or, in a variant, it could be hollow.

According to yet another aspect of the present disclosure, when the stem is not of circular cross-section, the cap can is fastened on the receptacle by snap-fastening or by some other means, without turning relative to said receptacle. The wiper can thus present a non-circular wiper orifice that is complementary to the cross-section of the stem.

According to an embodiment, the receptacle and the cap may be made of a rigid material like glass, metal, hard plastic or any other material known in the art. In alternate embodiments, the receptacle and the cap are made of a flexible material like flexible polymeric material or any other material known in the art.

According to an embodiment of the present disclosure, the applicator head can be made, at least in part, from a material that is more flexible than a material from which the stem is made. According to an embodiment, the receptacle and the cap may be made of a rigid material like glass, metal, hard plastic or any other material known in the art. In alternate embodiments, the receptacle and the cap are made of a flexible material such as flexible polymeric material or any other material known in the art.

According to a preferred embodiment, the applying member is elongated along a central longitudinal axis of the applicator head. The applying member has a longitudinal axis which is in alignment with a longitudinal axis of the stem. The applying member is elongated, that is to say its extent in a direction parallel to the longitudinal axis is larger than its largest extension perpendicularly to the longitudinal axis. Particularly, the largest extension of the applying member in the direction parallel to the longitudinal axis by at least a factor of 1.5, more preferably is greater by at least a factor of 2 than the greatest extension of the applying member in a direction perpendicular to the longitudinal axis of cosmetic applicator.

According to an embodiment of the present disclosure, the applicator head 10 and the stem are fitted together by a snap fitment. In alternate embodiments, the applicator head and the stem are fit together by friction fit, by gluing, crimping, magnetic engagement and the like. According to an embodiment of the present disclosure, the stem has a longitudinal axis that is rectilinear. In alternate embodiments, the stem is curved.

According to a third embodiment of the present disclosure, the applicator head comprises an elongated application body at a distal portion of the applicator head, the elongated application body is majorly of U-shaped cross section and of elongate form i.e. a longitudinal U-shaped cavity extends along a longitudinal axis of the applicator head. The application body has a curve in horizontal axis i.e. the application body has a concave inner surface and a convex outer surface opposite the inner surface. Thus, by horizontal axis curve, it is meant that the application body is curved in a horizontal axis perpendicular to the longitudinal axis of the application body (i.e. curved from left to right).

The applicator head is configured to be loaded with product to be applied. The distal end of the stem includes an interior longitudinal cavity for receiving and retaining the applicator head. More particularly, a proximal portion of the applicator head is formed as cylindrical shank, which is configured to be received within the longitudinal cavity of the stem. The molded applicator head may be fixed to the stem by force fitting, in particular by snapping, gluing, welding or crimping, the shank of the application head in longitudinal cavity of the stem provided at the end of the stem.

According to an embodiment of the present disclosure, the application body includes at least three vertical sidewalls, namely a first sidewall, a second sidewall and a third sidewall, the three sidewalls together defining the longitudinal U-shaped cavity among them which is adapted to receive the cosmetic product. The U-shaped cavity extends from a proximal to a distal end of the application body and is open at both the proximal and distal ends of the application body. The product accumulates in said U-shaped cavity allowing the cosmetic applicator to be used for at least a length of time sufficient to enable a product, such as a cosmetic or a care product, to be applied sufficiently. The first and second sidewalls form lateral sides of the U-shaped cavity and the third sidewall form the base of the U-shaped cavity. The U-shaped cavity has longitudinal opening opposing the third sidewall.

According to an embodiment of the present disclosure, the first and second sidewalls are two substantially parallel sidewalls of equivalent length and are horizontally aligned sidewalls. The first and second sidewalls are substantially parallel and are horizontally spaced so at form said U-shaped cavity with the third sidewall. The first and second sidewalls extend substantially orthogonal/perpendicularly from the third sidewall.

According to an embodiment of the present disclosure, the first and second sidewalls are configured to flex to change their angle to a non-perpendicular angle with respect to the third sidewall, under influence of external forces.

According to a further embodiment, the first and second sidewalls act like two flexible flaps that extend transversally from the third sidewall along the substantially entire length of the application body. During use, at least one of the flexible flaps flex inwardly towards the third sidewall during application to release the cosmetic product from the opening of the U-shaped cavity.

According to an embodiment of the present embodiment, the first and second sidewalls are configured to be folded relative to the third sidewall between a collapsed state and a rested state. In the rested state, the first and second sidewalls extend in substantially parallel directions and orthogonal/perpendicularly from the third connecting sidewall. In the collapsed sate, the first and second sidewalls flex to collapse inwardly towards the third sidewall and change their angle to a non-perpendicular angle with respect to the third sidewall.

According to the disclosure, the thickness, the material, and/or the connection of the first and second sidewalls to the third sidewall are selected such that the first and second sidewalls flex/pivot with respect to the third sidewall. More particularly, the first and second sidewalls fold inwardly towards the inner surface of third sidewall such that they abut each other and form a partially collapsed folded structure. More particularly, when the application body is under the influences of the external forces that are exerted on the application body by the wiper and/or the neck of the container, the first and second sidewalls flex/pivot inwardly towards the inner surface of third sidewall to form a partially collapsed folded structure and wherein the first and second sidewalls abut each other in the collapsed state. The external forces are exerted on the application body by the wiper and/or the neck of the container, when the application body is pulled out as intended by the wiper or the container neck or thrust back into the container again in the reverse direction. Further, when the force on the application body is removed, the first and second sidewall move back to their original state where the first and second sidewalls are substantially perpendicular to the third sidewall.

According to yet another embodiment, the longitudinal U-shaped cavity of the application body helps retaining the cosmetic product, which is available for loading, transporting and applying after wiping of the applicator head.

In the exemplary embodiment, each of said first and second sidewalls has a generally uniform thickness and a substantially flat vertical outer surface and inner surface. The third sidewall has a thickness greater than the thickness of the first and second sidewalls. Further, the outer and inner surfaces of the third sidewall are curved surfaces. The outer surface of each of the first and second sidewalls forms a curved and smooth corner with said outer surface of the third sidewall. Thus, a corner thickness is substantially greater than the uniform thickness of said first and second sidewalls.

According to a further embodiment of the present disclosure, the first and second sidewalls are integral with the third sidewall.

According to a further embodiment of the present disclosure, a distance between opposing inner surfaces of the first and second sidewalls define a span significantly less than the length of the first and second sidewalls or the third sidewall.

In preferred embodiment, the span being at least 2 times less than the length of the application body, more preferably at least 3 times less than the length of the application body, even more preferably at least 5 times less than the length of the application body.

The term "substantially perpendicular" includes the meaning that there is a slight variation from a particular direction. More particularly, the term "substantially perpendicular" means perpendicular state with a deviation of less than 10°.

The term "substantially parallel" includes the meaning that there is a slight variation from the parallel direction. In other words, two objects or axis are at least 5 degrees or 10 degrees within the parallelism (Five or ten degrees of parallel), it means extending parallel to each other.

The term "proximal" designates the side toward the later cap or the shank of the applicator head, while the term "distal" designates the side facing correspondingly away.

According to an aspect of the present disclosure, the applicator head may not be flocked.

According yet another embodiment of the present disclosure, the application body of the applicator head may have application elements on at least a portion of the inner or outer surface or at least on one of the three sidewalls. The application elements may be selected from a group of tines, flocking, a texture surface and the like.

According to a preferred embodiment, the application elements are flocking. The flocking can be implemented on a portion of the application body mechanically, electrostatically or by a combination of both technologies.

According to yet another aspect of the present embodiment, each of the first and second sidewalls has a greatest width greater than a greatest width of the third sidewall.

According to yet another embodiment, each of the first and second sidewalls has a width that varies along the longitudinal axis of the application body. More particularly, the width of the first and second sidewalls first increases from a distal end to up to a first portion of a length of the application body, then decreases to up to a second portion of the length of the application body and then again increases to up to a third portion of the length of the application body. The length of the second portion is greater than the length of the first portion and the length of the third portion; and the length of the first portion is greater than the length of the third portion.

Further, free edges of the each of the first and second sidewalls include a convex curve extending in the distal portion, the convex curve is followed by a straight edge in the middle portion; and the straight edge is followed by a concave curve near the proximal end of the first and second sidewalls respectively.

According to an aspect of the present disclosure, the application body may not be flocked.

In another embodiment, the applicator head may have application elements. In a preferred embodiment, the application elements are flocking, however in variant embodiments, the application elements may be projections, bristles, tines, particles, ribs, grooves, discs, slits, cuts, holes, dimples, foam or other surface features or surface treatments (e.g., abrading) that are suitable for combing and/or loading, transporting and applying cosmetic product such as, for example, mascara, eyeshadow and the like.

In variant embodiments, the application body may have a substantially C-shaped transverse cross-section and C-shaped longitudinal cavity.

According to an embodiment of the present disclosure, the application body may be fabricated from a material selected from a group consisting of elastomeric or deformable plastic, rubber, sintered or porous material and/or combinations thereof. The applicator head according to the disclosure can be manufactured in a single injection-molding step. The first and second sidewalls must be sufficiently thin, so that even if no soft elastic plastic is used, the first and second sidewalls may be able to flex and enfold a spring effect.

According to a fourth embodiment of the present disclosure, the applying member of the applicator head comprises a columnar root portion that forms a base of applying member and a circular wing extending from the columnar root portion. The circular wing is constituted by a circular plate-shaped structure which is curved in a plane perpendicular to a longitudinal axis of the applying member. The columnar root portion reduces gradually in thickness and width from a proximal end of the applying member to a proximal end of the circular wing. The circular wing defines a distal end of the applying member.

Further, the circular wing of the applying member defines at least two main application faces opposite to each other, namely a first application face and a second application face opposite to the first application face. At least one of the first application face and the second application face is concave, more particularly, the first application face has a concave outer surface and the second application face has a convex outer surface.

According to yet another embodiment of the present disclosure, the root portion has two extensions, namely a first extension and a second extension that extend longitudinally in opposite directions on respective the first application face and the second application face of the circular wing, and along the longitudinal axis of the applying member. Each of the first and second extensions extends along a longitudinal direction from the root portion of the applying member to up to at least a half a length of the respective faces the first application face and the second application face of the circular wing.

According to an embodiment of the present disclosure, the first and second extensions are like protrusions on the respective the first application face and the second application face. The first and second extensions define a rigid region on the applying member that provides bending resistance during application. The circular wing which is free from the first and second extensions defines a flexible region which is flexible enough to flex and adjust according to contour of the application surface, thus allowing even and smooth application of the product during application.

According to an embodiment of the present disclosure, the first and second extensions of the root portion are identical in shape and dimensions and extend parallel to each other over their entire length.

In an alternate embodiment, the first and second extensions of the root portion are not identical in shape and dimensions and may or may not extend in parallel directions. For example, in a second embodiment of the applicator head according present disclosure, the first and second extensions of the root portion are of non-identical shapes and have different length along a longitudinal direction of the applying member.

According a further embodiment of the present disclosure, a length of each of the first and second extensions of the root portion is about at least 40% of a total length of the circular wing but less than 95% of the length of the circular wing.

Preferably, the total length each of the first and second extensions of the root portion is longer than its width, for example several times larger than its width, i.e. more than 2, 3, 4, 5 or 6 times its width.

The first and second extensions may have any geometric cross-section, and may be, e.g., a rounded or have a rectangular, triangular, square, or an irregular cross-section.

The circular wing is flexible enough to flex during application along contours of the human facial skin or lips so as to provide an even coating of the cosmetic product. The applying member picks up generous amount of the cosmetic product in the concave outer surface of the first application face.

According to an embodiment of the present disclosure, an outer surface of the applying member is covered with application element which in this case is flocked fibers. Briefly, the fibers for flocking which may be of any commonly used material, such as nylon, polyester or any natural fiber are applied with an adhesive, such as an epoxy, to the surface to be flocked. The flocking finish to the outer surface of the applying member may be achieved by an appropriately chosen known technique, such as electrostatic flocking.

According to an aspect of the present disclosure, the applying member may be flocked over substantially its entire visible surface. In a variant, at least one of the first and second extensions of the applying member may be flocked. In yet another variant, only the circular wing that is used for applying the composition may be flocked.

According to an embodiment of the present disclosure, the circular wing may have a smooth or a rough surface, before flocking. Preferably, at least one of the first application face or the second application face has a textured surface. According to a variant embodiment of the present disclosure, the circular wing has a massaging texture on the convex surface of the second application face for skin stimulation and enhanced absorption of the cosmetic product, and whereas the first application face has a concave surface for smooth application of the cosmetic product. The massaging texture preferably includes a faceted surface.

According to yet another embodiment of the present disclosure, there is provided a cosmetic package comprises a receptacle for holding a product and the cosmetic applicator. The cap of the cosmetic applicator has threads which can be screwed onto threads formed on a neck of the receptacle. Further, the distal end of the stem may include an interior longitudinal cavity for receiving and retaining the applicator head.

There may inserted in the neck of the receptacle, a wiper for wiping off excess product from the cosmetic applicator. Further, the wiper comprises a wiping orifice.

According to an embodiment of the present disclosure, the shank portion inserted fixedly into the stem is molded integrally with the circular wing. According to yet another embodiment of the present disclosure, upon withdrawing the cosmetic applicator from the state of being immersed in the cosmetic product, the cosmetic product is picked up and retained on the entire surface of the circular wing due to flocking. The widest part of the circular wing has a larger width than the widest part of the wiper orifice. Accordingly, when the cosmetic applicator is withdrawn from the receptacle, the widest part of the circular wing catches in the wiper orifice of the wiper. Since, the circular wing is made of an elastically deformable material in the present embodiment, it is deformed at the widest part catching in the wiper orifice so as to be able to pass through the wiper orifice. Since, the first application face of the circular wing, where most of the cosmetic product is retained, has a concave outer surface, the circular wing is curled into a substantial C-shape. Since, the circular wing is curled into the substantially C-shape, the cosmetic product remains retained inside the C-shape while the circular wing is in a deformed state. On the other hand, the second application face has a convex outer surface and is wiped by the wiper. The second application face is wiped more and acts as a blending surface for easy application of the cosmetic product which is applied by the first application face of the circular wing.

According to an embodiment of the present disclosure, the wiper is made of an elastically deformable material, so that both the circular wing and the wiper orifice are deformed to reduce the resistance against the withdrawal and insertion, whereby the convenience of use is further improved.

After the circular wing passes through the wiper orifice, it restores the original shape with no force by the wiper orifice imposed thereto. Accordingly, as the original shape is restored, the cosmetic product is spread over the entire area of the first application face of the circular wing. As a result, the circular wing is able to apply the cosmetic product uniformly to the lips or any other part of the body. At this time, there is very little retention of the cosmetic product on the second application face of the circular wing, so that a user can apply the cosmetic product quickly at ease without feeling worried about unintentional application to other than the target region.

The wiper serves to wipe off not only the excess cosmetic product attached to the circular wing but also the cosmetic product attached to the stem.

According to an embodiment, the container and the cap may be made of a rigid material like glass, metal, hard plastic or any other material known in the art. However, in alternate embodiments, the container and the cap may be made of a flexible material like flexible polymeric material or any other material known in the art.

According to an embodiment of the present disclosure, the stem presents a cross-section that is circular, but it is not beyond the ambit of the present disclosure for this to be otherwise. According to another embodiment the cross-section of the stem is oval, elliptical or polygonal, e.g. square, triangular or rectangular. The stem can be solid as shown, or, in a variant, it could be hollow.

When the stem is not of circular cross-section, the cap can be fastened on the receptacle by snap-fastening or by some other means, without turning relative to said receptacle. The wiper can thus present a non-circular wiper orifice of section that is complementary to the cross-section of the stem.

According to an embodiment of the present disclosure, the applicator head can be made, at least in part, from a material that is more flexible than a material from which the stem is made. According to an embodiment, the receptacle and the cap may be made of a rigid material like glass, metal, hard plastic or any other material known in the art. In alternate embodiments, the receptacle and the cap are made of a flexible material such as flexible polymeric material or any other material known in the art.

According to an embodiment of the present disclosure, the applicator head and the stem are fitted together by a snap fitment. However, in alternate embodiments, the applicator head and the stem may be fit together by friction fit, by gluing, crimping, magnetic engagement and the like.

According to an embodiment of the present disclosure, the stem can have a longitudinal axis Y that is rectilinear as shown. In alternate embodiments, the stem is curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
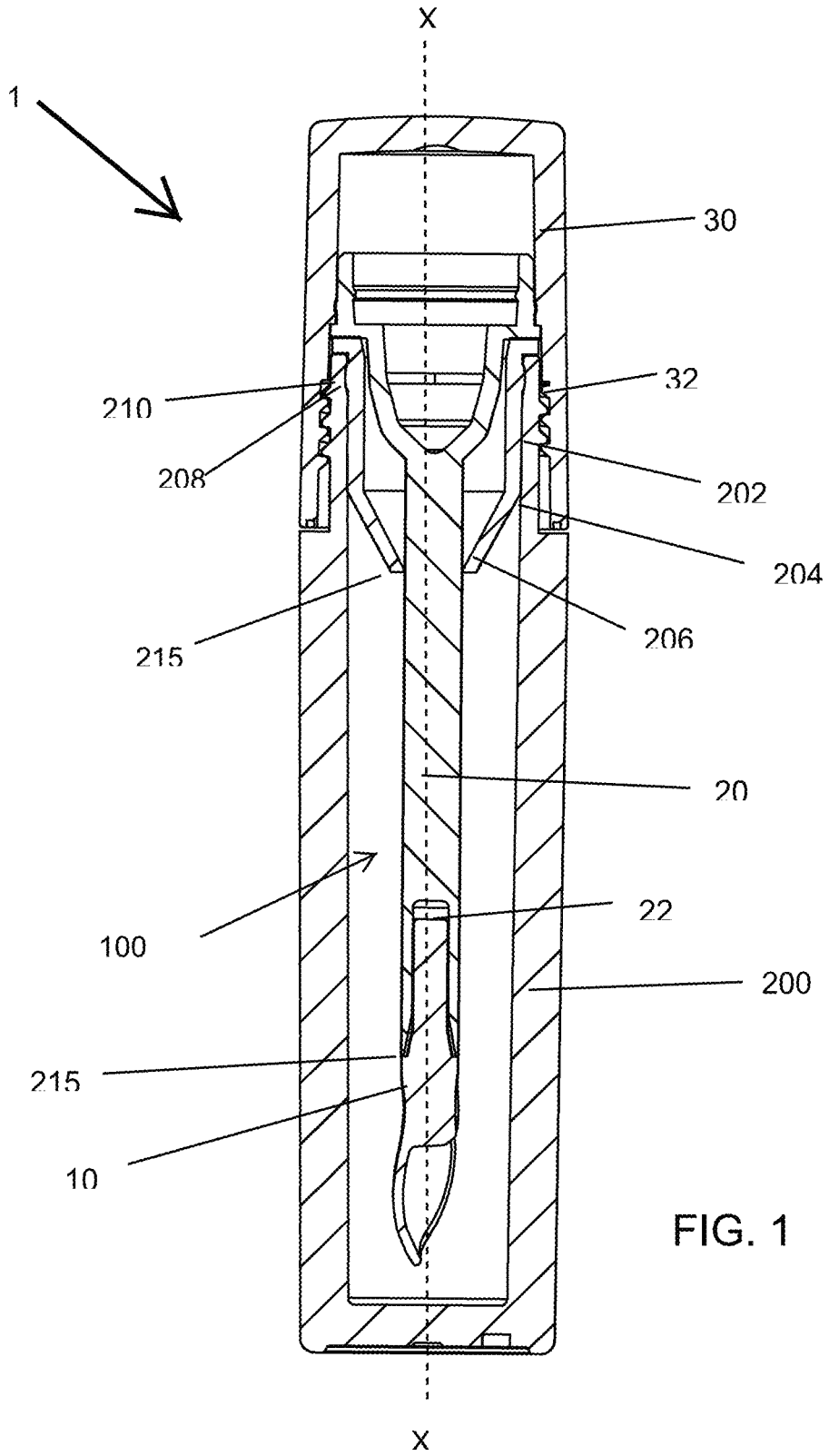
FIG. 1 illustrates a longitudinal sectional view of a cosmetic package in a closed position according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

FIG. 1 illustrates a longitudinal sectional view of a cosmetic package 1 according to a first embodiment of the present disclosure. The cosmetic package 1 comprises a receptacle 200 and a cosmetic applicator 100. The receptacle 200 is configured to contain a product (not shown) including a cosmetic, care or pharmaceutical product. However, in alternate embodiments, the receptacle 200 may include a separate inner reservoir to hold a volume of the product to be dispensed. The cosmetic, care or pharmaceutical product includes viscous cosmetics, mascara, eyebrow powder, lip gloss, hair color, cheek blush, skin care, under eye cosmetics, pharmaceutical and like products.

As shown in FIG. 1, the cosmetic package 1 is of an elongated cylindrical configuration. However, in alternate embodiments, the cosmetic package 1 is of an elongated square, polygonal configuration, oval, triangular, heart, or any other configuration known in the art.

According to an embodiment, the cosmetic applicator 100 comprises an applicator head 10, a stem 20 and a closure 30. The closure 30 of the cosmetic package 1 has threads 32 on its inner surface which can be screwed onto threads 202, formed on an outer surface of a neck 204 of the receptacle 200. However, in alternate embodiments, the closure 30 snaps into place on the neck 204 of the receptacle 200 or any other type of mechanisms may be used to mate the closure 30 to the receptacle 200.

Inserted in the neck 204 of the receptacle 200 is a wiper 206 for wiping off excess cosmetic product from the cosmetic applicator 100. The wiper 206 also comprises an annular bead 208 on its outer surface for engaging into a corresponding annular groove 210 formed on an inside surface of the neck 204 of the receptacle 200. Further, the wiper 206 comprises a wiping orifice 215.

According to an embodiment, the receptacle 200 and the closure 30 may be made of a rigid material like glass, metal, hard plastic or any other material known in the art. However, in alternate embodiments, the receptacle 200 and the closure 30 are made of a flexible material like flexible polymeric material or any other material known in the art.

According to an embodiment of the present disclosure, the applicator head 10 and the stem 20 are fitted together by a snap fitment. However, in alternate embodiments, the applicator head 10 and the stem 20 may be fit together by friction fit, by gluing, crimping, magnetic engagement and the like. According to an embodiment of the present disclosure, the stem 20 can have a longitudinal axis X-X that is rectilinear as shown. However, in alternate embodiments, the stem is curved.

According to an embodiment of the present disclosure, the stem 20 presents a cross-section that is circular. According to other embodiments the cross-section of the stem 20 is oval, elliptical or polygonal, e.g. square, triangular or rectangular. The stem 20 can be solid as shown, or, in a variant, it could be hollow.

When the stem 20 is not of circular cross-section, the closure 30 may be fastened on the receptacle 200 by snap-fastening or by some other means, without turning relative to said receptacle 200. The wiper 206 can thus present a non-circular wiper orifice 215 of section that is complementary to the cross-section of the stem 20.

According to an embodiment of the present disclosure, the applicator head 10 can be made, at least in part, from a material that is more flexible than a material from which the stem 20 is made.

According to an embodiment of the present disclosure, at least a part and preferably all of the applicator head 10 can be made by molding, e.g. by injection-molding. It is formed from a material known to those of skill in the art as suitable for injection molding including thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

Figure 2:
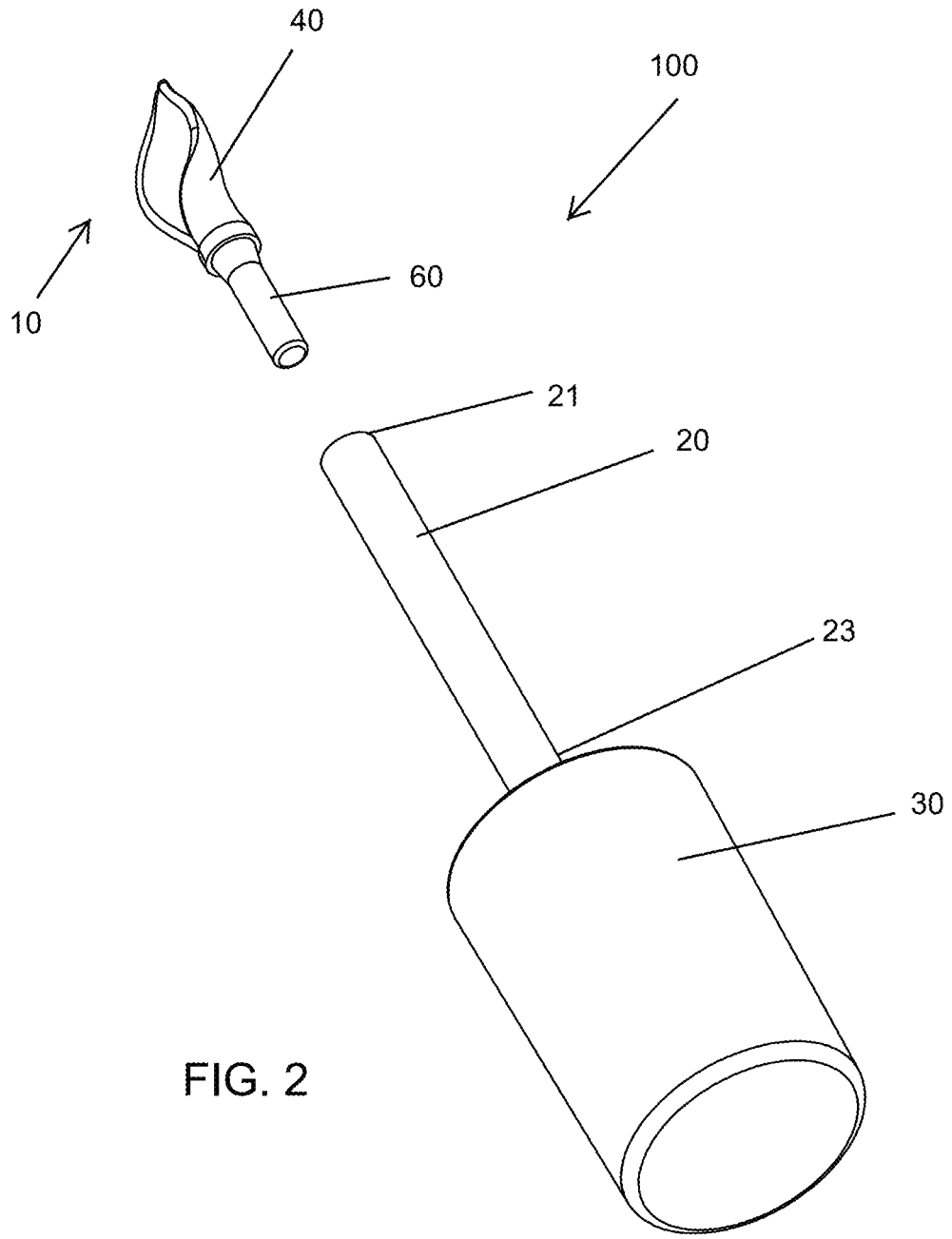
FIG. 2 illustrates an exploded view of a cosmetic applicator of the cosmetic package of FIG. 1.
Figure 4:
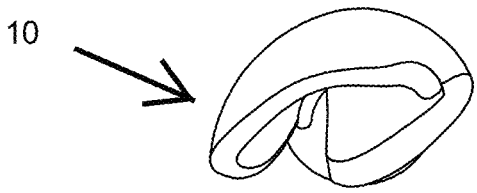
FIG. 4 illustrates a top view of the applicator head of FIG. 3.

As shown in FIG. 2, the applicator head 10 comprises an applying member 40 and a shank portion 60. The shank portion 60 retained at a distal end 21 of the stem 20 for applying the cosmetic product; and the closure 30 is retained at a proximal end 23 of the stem 20. The distal end 21 of the stem 20 includes an interior longitudinal cavity 22 (refer FIG. 1) for receiving and retaining the applicator head 10.

According to an embodiment, the applying member 40 is preferably formed in Desmopan® 487. Desmopan® 487 is a thermoplastic polyurethane. In alternate embodiments, the applying member 40 may be formed from any suitable polymeric material or any other material known in the art.

Figure 7:
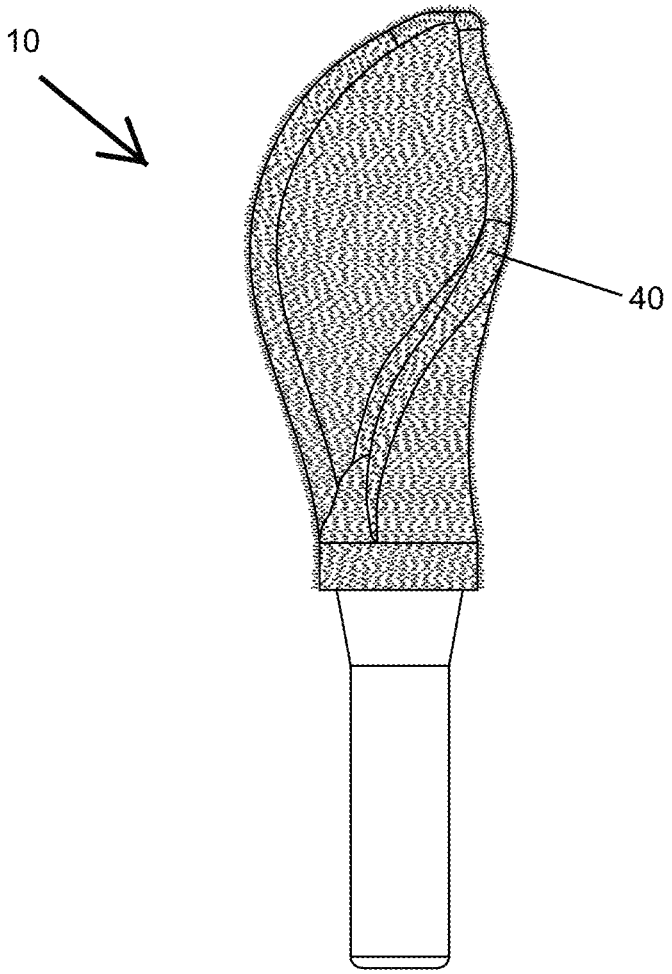
FIG. 7 shows a perspective view of the applicator head of FIG. 2 with flocking on the applying member of the applicator head.

According to an embodiment of the present disclosure, an outer surface of the applying member 40 is covered with application element which in this case is flocked fibers, refer FIG. 7. Briefly, the fibers for flocking which may be of any commonly used material, such as nylon, polyester or any natural fiber are applied with an adhesive, such as an epoxy, to the surface to be flocked. The flocking finish to the outer surface of the applying member 40 may be achieved by an appropriately chosen known technique, such as electrostatic flocking.

The outer surface of the applying member 40 before being flocked is smooth on its entire surface. That is, the outer surface of the applying member 40 before being flocked has no surface textures, such as a wrinkle finish or a matte finish, over the entire surface thereof. To put it another way, the outer surfaces of the applying member 40 before being flocked are smooth and slippery.

Preferably, the flocking process takes place in an electrostatic field, which results in the proper orientation of the fibers. The flock on the outer surface of the applying member 40 provides a layer which can hold a small amount of the cosmetic product adequate for one or two applications. In alternate embodiments, the outer of the applying member 40 may include injection molded fibers, projections or grooves which are capable of holding the cosmetic product.

According to an embodiment of the present disclosure, the outer surface of the applying member 40 is covered by a flock coating. However, in alternate embodiments, the outer surface of the applying member 40 may not be covered by a flock coating.

Figure 3:
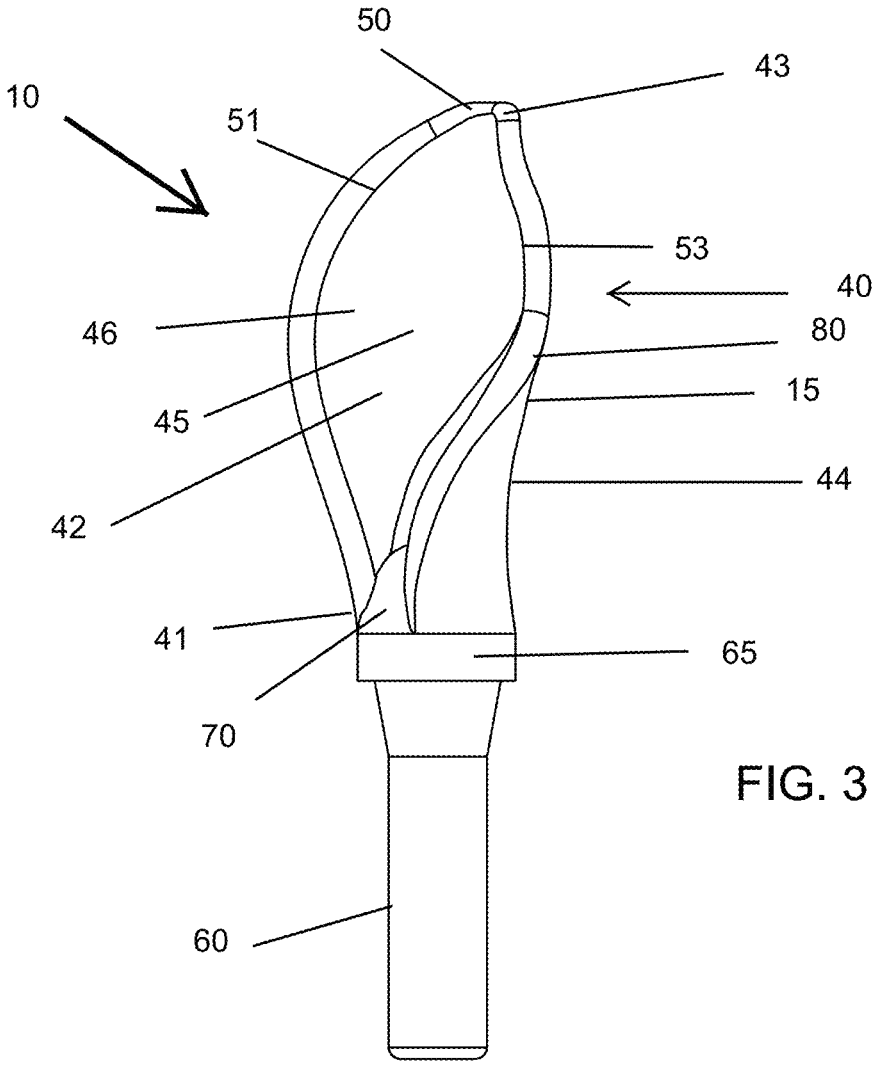
FIG. 3 illustrates a front view of an applicator head of the cosmetic applicator of FIG. 2.

As shown in FIG. 3, the applying member 40 further comprises a root portion 65 and a spatula 80. The spatula 80 extends from the root portion 65. The root portion 65 is cylindrical in shape. However, according to alternate embodiments, the root portion 65 may be circular or any other shape known in the art.

The spatula 80 has an elongated support body 15 extending along the longitudinal axis X-X of the cosmetic applicator 100 (refer FIG. 1). The spatula 80 comprises at least two application faces namely a first application face 42 and a second application face 44. The first application face 42 has a concave inner surface 46 while the second application face 44 has a convex outer surface 47 (refer FIG. 5A). The concave inner surface 46 creates a volume reservoir. This volume reservoir serves as a reservoir for the cosmetic product. A significant quantity of the cosmetic product can be accommodated in said volume reservoir which is available to be applied to the user's skin or keratinous substrate.

Figure 5A:
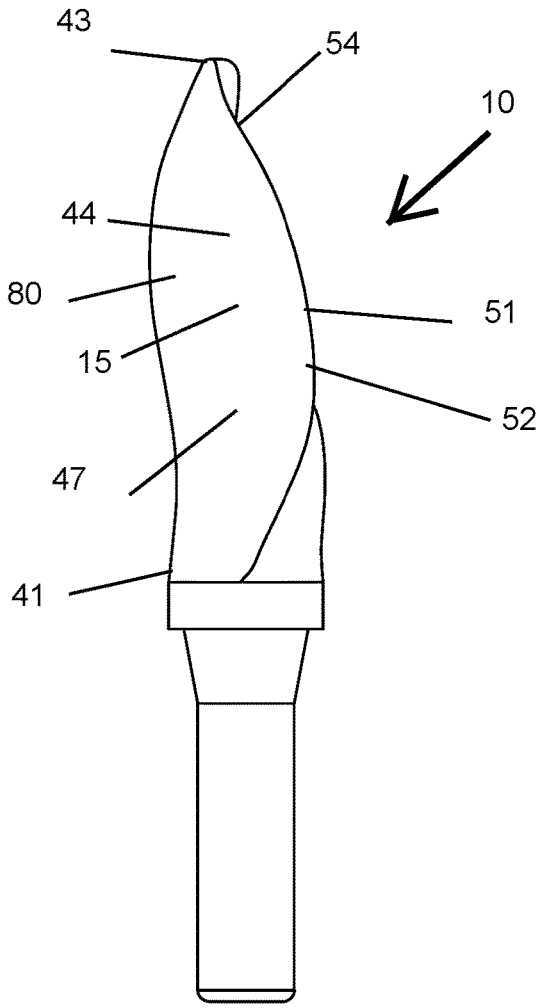
FIG. 5A illustrates a right-side view of the applicator head of FIG. 3.
Figure 5B:
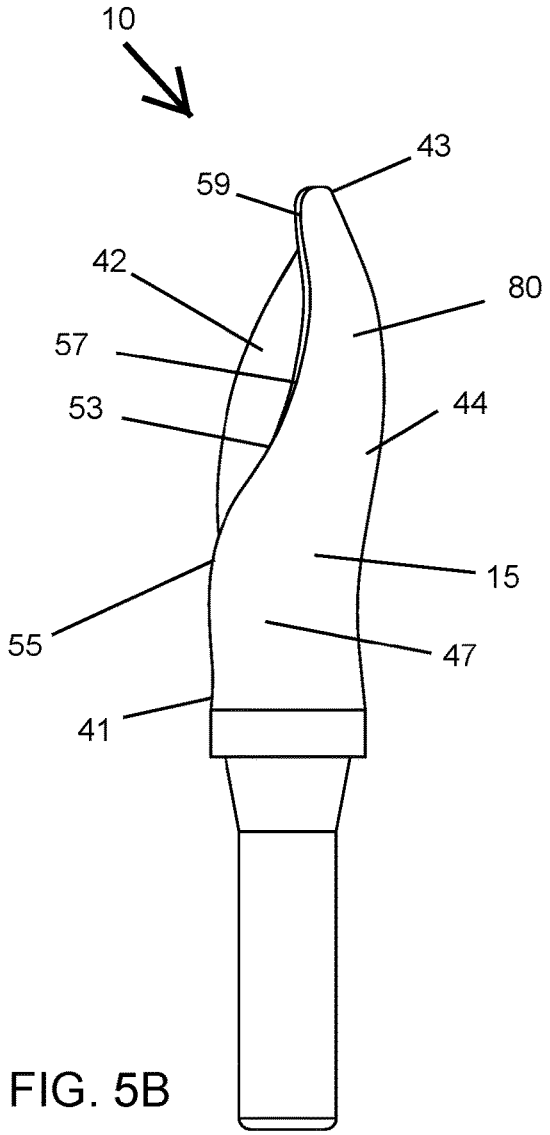
FIG. 5B illustrates a left side view of the applicator head of FIG. 3.

As shown in FIGS. 5A and 5B, the second application face 44 has a convex outer surface 47 which acts a large blending surface for easy application of the cosmetic product.

As shown in FIG. 3, the spatula 80 has two free edges, a first longitudinal edge 51 and a second longitudinal edge 53. The first longitudinal edge 51 and the second longitudinal edge 53 of the spatula 80 are asymmetrical with respect to each other and are each curvilinear. The first longitudinal edge 51 extends in all three dimensions of space. As shown in FIG. 5A, the first longitudinal edge 51 comprises a first curve 52 that is outwardly convex and a second curve 54 that is outwardly concave. When seen from a proximal end 41 to a distal end 43 of the spatula 80, the first curve 52 is followed by the second curve 54 on the first longitudinal edge 51.

The first and second curves differ from one another by the nature of their curves or by their radius of curvatures. According to the disclosure, when the curve does not correspond to a circular arc, the "radius of curvature is measured at the apex of the curve". The first curve 52 is produced about a first axis of curvature to a first radius of curvature. The second curve 54 is produced about a second axis of curvature to a second radius of curvature. The first axis of curvature and the second axis of curvature are non-parallel and extend in different directions. The first radius of curvature may or may not be same as second radius of curvature. More particularly, the first radius of curvature is greater than the second radius of curvature such that the first curve 52 extends up to at least 75% of a length of the first longitudinal edge 51.

As shown in FIG. 5B, the second longitudinal edge 53 also extends in all three dimensions of space. The second longitudinal edge 53 comprises a third curve 55 that is outwardly convex, a fourth curve 57 that is outwardly concave, and a fifth curve 59 that is outwardly convex.

The third, fourth, fifth curves 55, 57, 59 differ from one another by the nature of their curves or by their radius of curvatures. The third curve 55 is produced about a third axis of curvature to a third radius of curvature. The fourth curve 57 is produced about a fourth axis of curvature to a fourth radius of curvature. The fifth curve 59 is produced about a fifth axis of curvature to a fifth radius of curvature.

The third, fourth, fifth axis of curvatures is non-parallel and extends in different directions. The radius of curvatures of third, fourth, fifth may or may not be same. Particularly, the third radius of curvature and the fourth radius of curvature may or may not be equal. In the exemplary embodiment shown in FIG. 5B, the fourth radius of curvature is greater than the third radius of curvature. The fifth radius of curvature is less than the fourth and the fifth radius of curvature. More particularly, at least one of the third curve 55 or the fourth curve 57 extends up to at least 30% of a length of the second longitudinal edge 53. The fifth curve 59 extends up to at least 10% of a length of the second longitudinal edge 53.

When seen from the proximal end 41 to the distal end 43 of the spatula 80, the third curve 55 is followed by the fourth curve 57 which is further followed by the fifth curve 59 on the second longitudinal edge 53.

As shown in FIG. 3, the first application face 42 has a recess 45 which is substantially enclosed by the first longitudinal edge 51 and the second longitudinal edge 53 except at the proximal end 41 of the spatula 80. A gap 70 is present between the first longitudinal edge 51 and the second longitudinal edge 53, near the proximal end 41 of the spatula 80. The recess 45 promotes retention of the cosmetic product.

When the cosmetic applicator 100 is applied to keratinous substrate, the cosmetic product present in the recess 45 can be deposited and the surface of cosmetic product coming into contact with the lips or any other part of the body may be relatively large, so that the lips or any other part of the body can be masked relatively quickly.

The recess 45 extends longitudinally from the proximal end 41 to the distal end 43 of the spatula 80. Further, the recess 45 extends along a longitudinal axis which does not coincide with the longitudinal axis X-X of the cosmetic applicator 100 (refer FIG. 1). More particularly, the recess 45 is off-centered with respect to the longitudinal axis X-X of the cosmetic applicator 100 and makes a non-zero angle with longitudinal axis X-X of the cosmetic applicator 100. The recess 45 is open to the outside throughout the length of the spatula 80 via the first application face 42 for use in applying the product.

According to a preferred embodiment, the recess 45 extends over more than half of the width of the spatula 80. However, in alternate embodiments, the recess 45 may not extend over more than half of the width of the spatula 80. The width of the recess 45 passes through an extremum between the proximal end 41 and the distal end 43 of the spatula 80. The extremum being for example a maximum. More particularly, when viewed from the front, the recess has a widest part which gradually decreases in width from the widest part to either the proximal end 41 or the distal end 43 of the spatula 80.

According to a preferred embodiment, the recess 45 may be traversing over more than half the length of the spatula 80. However, in alternate embodiments, the recess 45 may not be traversing over more than half the length of the spatula 80.

The first longitudinal edge 51 and the second longitudinal edge 53 converge to form a narrow tip 50 at the distal end 43 of the spatula 80. The narrow tip 50 helps in precise deposition of the cosmetic product on applying the cosmetic product on the user's skin or keratinous substrate.

Further, according to one embodiment the narrow tip 50 does not coincide with the longitudinal axis X-X of the cosmetic applicator 100 (refer FIG. 1). More particularly, the narrow tip 50 is off-centered with respect to the longitudinal axis X-X of the cosmetic applicator 100.

At the time of use of said cosmetic package 1, the user first separates the closure 30 from the receptacle 200. In order to apply the cosmetic product onto the keratinous substrate such as skin, lips, eyelids, cheeks, nails or any other part of the body, the cosmetic applicator 100 is dipped into the cosmetic product in the receptacle 200 and then can be applied by the applicator head 10. Upon withdrawing the cosmetic applicator 100 from the state of being immersed in the cosmetic product (the state shown in FIG. 1), the cosmetic product is picked up and retained on the entire surface of the spatula 80.

As shown in FIG. 1, the widest part of the spatula 80 has a larger width than the widest part of the wiper orifice 215. Accordingly, when the cosmetic applicator 100 shown in FIG. 1 is withdrawn from the receptacle 200, the widest part of the spatula 80 catches in the wiper orifice 215 of the wiper 206. Since the spatula 80 is made of an elastically deformable material in the present embodiment, it is deformed at the widest part catching in the wiper orifice 215 so as to be able to pass through the wiper orifice 215.

Figure 6A:
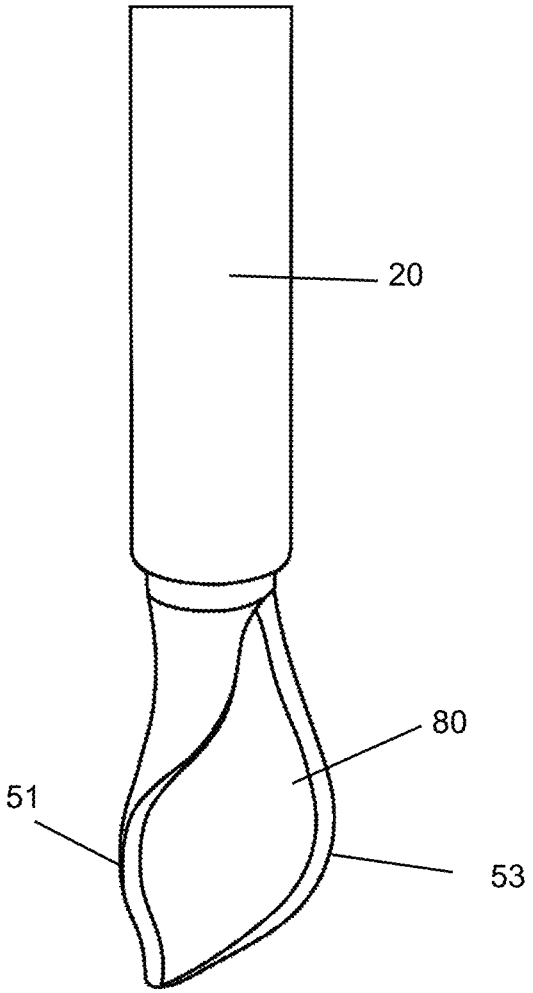
FIG. 6A illustrates a perspective view of a portion of the cosmetic applicator of FIG. 2 showing an applying member of the cosmetic applicator in a rest or non-deformed state as shown in FIG. 1.
Figure 6B:
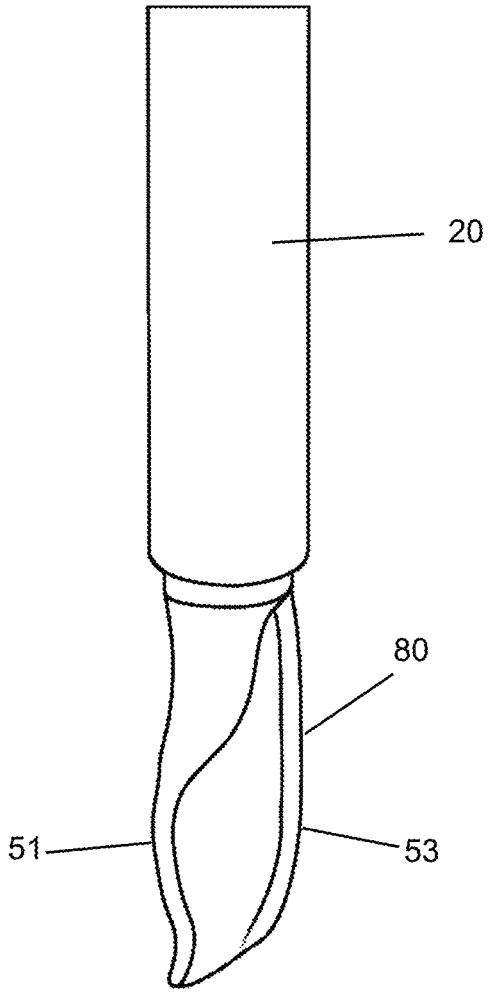
FIG. 6B illustrates another perspective view of the portion of the cosmetic applicator of FIG. 6A showing the applying member of the cosmetic applicator in a deformed state.

Since the first application face 42 of the spatula 80, where most of the cosmetic is retained, has the concave inner surface 46, the spatula 80 is curled into a substantial C-shape with the first longitudinal edge 51 and the second longitudinal edge 53 approaching towards each other as shown in FIG. 6B. Since the spatula 80 is curled into the substantially C-shape, the cosmetic product remains retained inside the C-shape while the spatula 80 is in a deformed state. On the other hand, the second application face 44 has the convex outer surface 47 and is wiped by the wiper 206. The second application face 44 is deprived of the cosmetic product and acts as a blending surface for easy application of the cosmetic product which is applied by the first application face 42 of the spatula 80.

The wiper 206 is made of an elastically deformable material, so that both the spatula 80 and the wiper orifice 215 are deformed to reduce the resistance against the withdrawal and insertion, whereby the convenience of use is further improved.

After the spatula 80 passes through the wiper orifice 215, it restores the original shape as shown in FIG. 6A with no force by the wiper orifice 215 imposed thereto. Accordingly, as the original shape is restored, the cosmetic product is spread over the entire area of the first application face 42 of the spatula 80. As a result, the spatula 80 is able to apply the cosmetic product uniformly to the lips or any other part of the body. At this time, there is very little retention of the cosmetic product on the second application face 44 of the spatula 80, so that a user can apply the cosmetic product quickly at ease without feeling worried about unintentional application to other than the target region.

The wiper 206 serves to wipe off not only the excess cosmetic product attached to the spatula 80 but also the cosmetic product attached to the stem 20.

Figure 8:
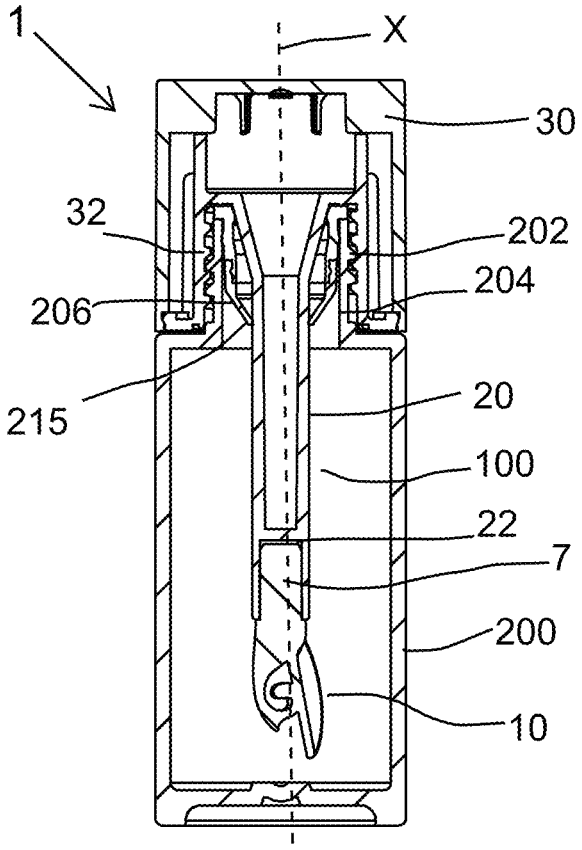
FIG. 8 shows a cross-sectional view of a cosmetic package equipped with a cosmetic applicator according to a second embodiment of present disclosure.
Figure 9:
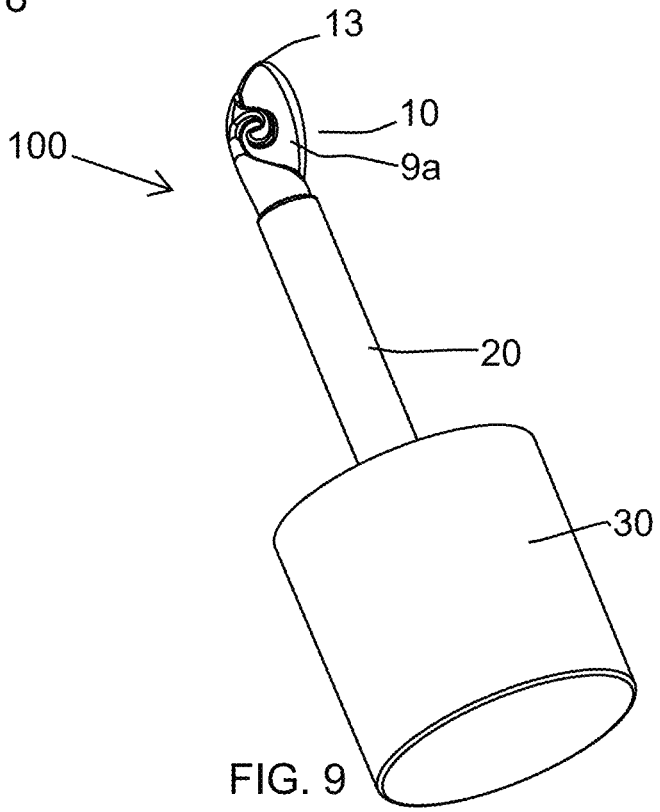
FIG. 9 shows a perspective view of the cosmetic applicator of FIG. 8.

FIG. 8 illustrates a longitudinal sectional view of a cosmetic package 1 according to another embodiment of the disclosure. The cosmetic package 1 is similar to the cosmetic package discussed with respect to FIGS. 1, 18 and 24 and comprises a receptacle 200 for holding a product (not shown) and a cosmetic applicator 100. The cosmetic applicator 100 comprises an applicator head 10, a stem 20, and a cap 30. The cap 30 of the cosmetic applicator 100 has threads 32 which can be screwed onto threads 202, formed on a neck 204 of the receptacle 200. The applicator head 10 retained at a distal end of the stem 20 for applying the product; and the cap 30 at a proximal end of the stem 20.

In general, the use of the terms "distal" and "proximal" herein means that the distal side/end is the side/end facing towards the inside of the storage receptacle 200, whereas the proximal side/end is the side/end facing towards the removal opening of the receptacle 200. Further, the distal end of the stem 20 includes an interior longitudinal cavity 22 for receiving and retaining the applicator head 10.

Figure 10:
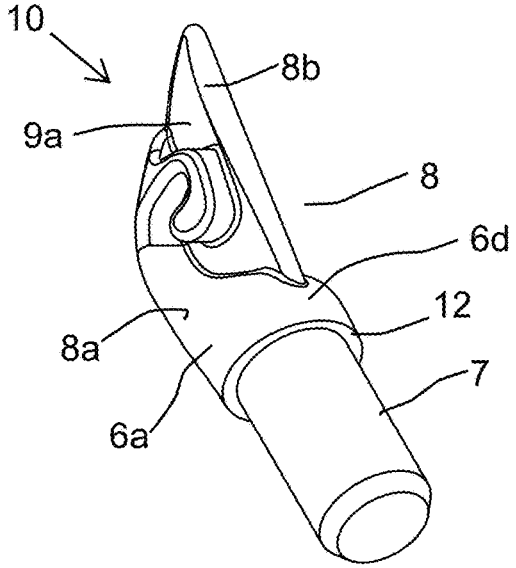
FIG. 10 shows a perspective view of an applicator head of the cosmetic applicator of FIG. 9.
Figure 11:
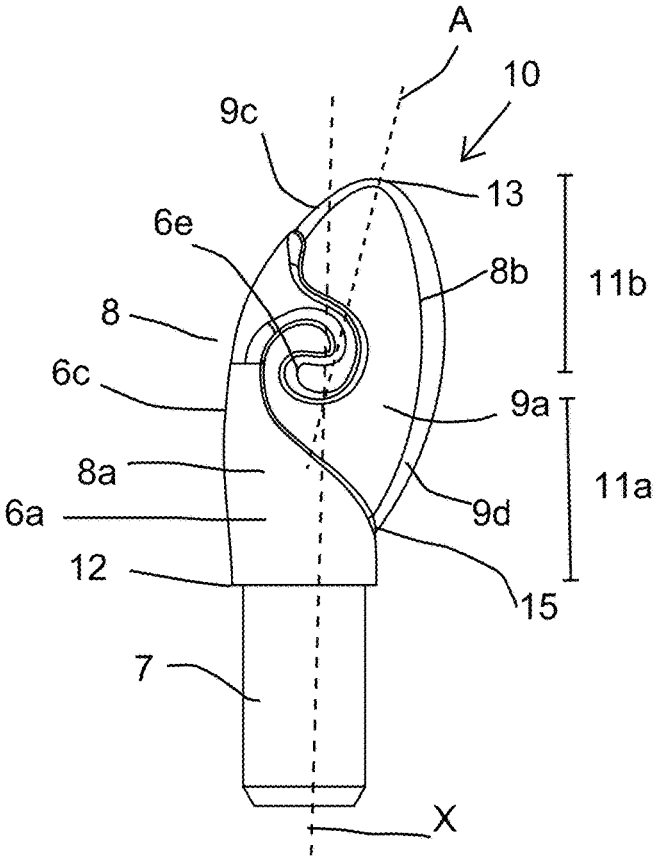
FIG. 11 shows a front view of the applicator head of FIG. 9.
Figure 12:
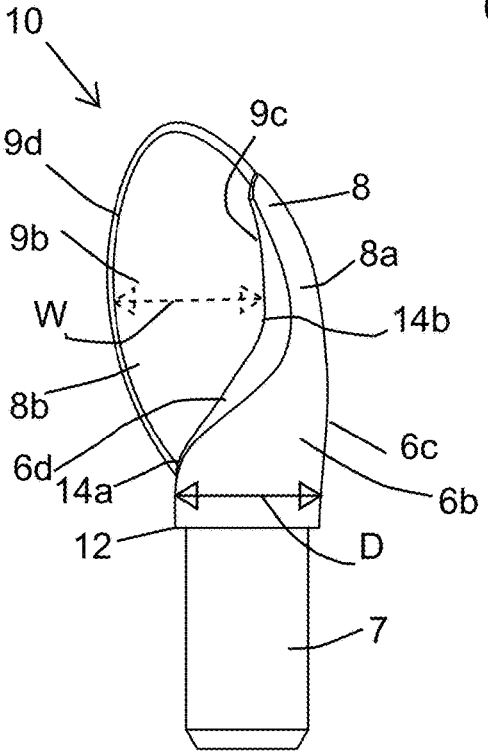
FIG. 12 shows a back view of the applicator head of FIG. 9.

Inserted in the neck 204 of the receptacle 200 is a wiper 206 for wiping off excess product from the cosmetic applicator 100. Further, the applicator head 10 of cosmetic applicator 100 may be used to apply the product including a cosmetic or care product. The cosmetic or care product includes viscous cosmetics, mascara, eyebrow powder, lip gloss, hair color, skin care, under eye cosmetics, pharmaceutical and like products. As shown in FIGS. 10-12, the applicator head 10 according to this embodiment comprises an applying member 8 at its distal portion and a shank member 7 at its proximal portion. The shank member 7 is configured to be received and retained within the longitudinal cavity 22 of the stem 20 (see FIG. 8).

Figure 13:
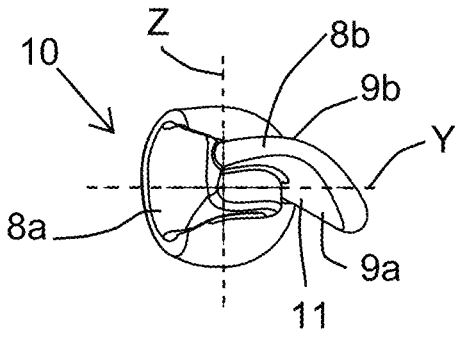
FIG. 13 shows a top view of the applicator head of FIG. 16.

The applying member 8 further comprises a support body 8*a* and a wing 8*b* extending from the support body 8*a*. The support body 8*a* extends in a direction of a longitudinal axis X of the applicator 100. Referring to FIGS. 11 and 13, the wing 8*b* is curved in a horizontal axis Y which is perpendicular to the X axis i.e. the wing 8*b* is curved from left to right such that the wing 8*b* defines a longitudinal concavity 11. The wing 8*b* has a concave front face 9*a* and a convex back face 9*b* opposite the concave front face 9*a*. The convex back face 9*b* provides a large blending surface for smooth and efficient application of the cosmetic product. The applying member 8 picks up generous amount of product in the concave front face 9*a* of the wing 8*b* so no re-dips are required during application.

More particularly, longitudinal concavity 11 of the concave front face 9*a* of the wing 8*b* promotes retention of the cosmetic product. When the cosmetic applicator 100 is applied to keratinous substrate, the cosmetic product present in the concavity 11 can be deposited and the surface of cosmetic product coming into contact with the lips or any other part of the body may be relatively large, so that the lips or any other part of the body can be masked relatively quickly.

According to an aspect of the present disclosure, the longitudinal concavity 11 extends longitudinally along a length of the wing 8*b*, along a longitudinal axis A which does not coincide with the longitudinal axis X of the applying member 8/stem 20 (refer FIG. 8). More particularly, the longitudinal concavity 11 is off-centered with respect to the longitudinal axis X of the applying member 8 and makes a non-zero angle with longitudinal axis X of the applying member 8.

As shown in FIG. 11, the wing 8*b* has a first lateral edge 9*c* and a second lateral edge 9*d* opposite the first lateral edge 9*c*. Wherein at least a portion of the first lateral edge 9*c* is a joining edge 9*c* which joins with the support body 8*a* such that the support body 8*a* supports the wing 8*b* laterally on both faces 9*a*, 9*b* of the wing 8*b*. In other words, the support body 8*a* supports the wing 8*b* laterally. At least a major portion of the support body 8*a* of the applying member 8 forms at least a major portion of a proximal portion 11*a* of the applying member 8.

A proximal end 12 of the support body 8*a* is connected to the shank portion 7, and the wing 8*b* of the applying member 8 is connected to a region of the support body 8*a* lying opposite to the shank portion 7, and wherein the wing 8*b* forms a major portion of a distal portion 11*b* of the applying member 8.

Referring FIGS. 11-15, the support body 8*a* includes two opposing main faces, namely a first front face 6*a*, an opposing second back face 6*b*, and two opposing lateral faces namely a third lateral face 6*c* and a fourth lateral face 6*d*. The third lateral face 6*c* is convexly curved along longitudinal axis X as well as along an axis Z which is substantially perpendicular to the X and Y axes. Further, the fourth lateral face 6*d* comprises a convex curve 14*a* followed by a concave curve 14*b* when seen from the proximal portion 11*a* towards the distal portion 11*b* of the support body 8*a*, see FIG. 12.

The wing 8*b* extends laterally from the said fourth lateral face 6*d* of the support body 8*a*. The joining edge 9*c* of the wing 8*b* connects along at least a part of the convexly curved and the concavely curved surface of the fourth lateral face 6*d* of the support body 8*a*. In alternate embodiments, the curves of the third and fourth lateral faces 6*c*, 6*d* or the shape of the support body 8*a* may be different, and thus the disclosure is not limited by the curves of the third and fourth lateral faces 6*c*, 6*d* or the shape of the support body 8*a*.

A width D of the support body 8*a* and/or the first front face 6*a*/the second back face 6*b* decreases continuously from a proximal end of the applying member 8 towards the distal portion 11*b* of the applying member 8, as seen FIGS. 11-12, illustrating a front view and a back view of the applying member 8. The applying member 8 is made of an elastomer, in particular, of a thermoplastic elastomer.

Figure 14:
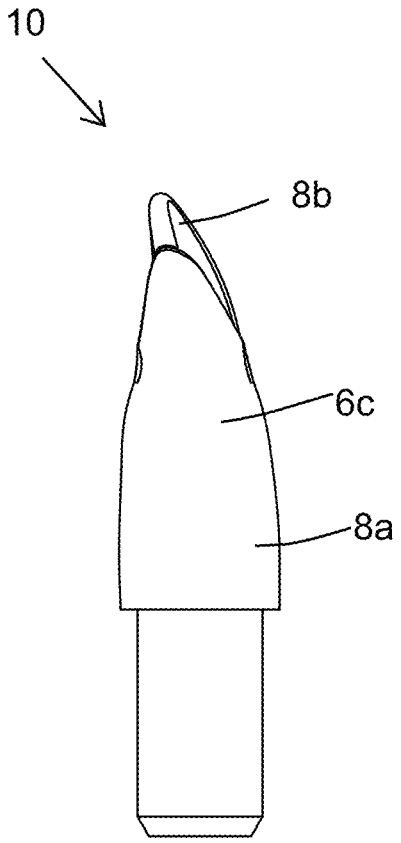
FIG. 14 shows a left side view of the applicator head of FIG. 16.
Figure 15:
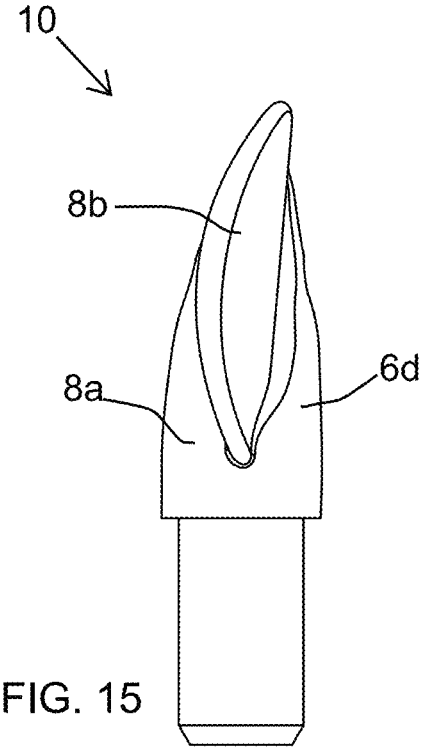
FIG. 15 shows a right side view of the applicator head of FIG. 16.
Figure 16:
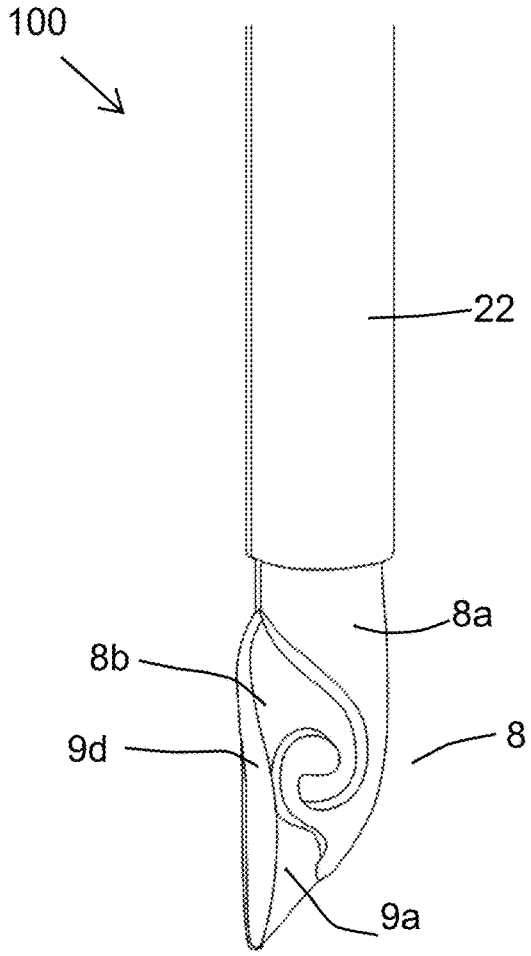
FIG. 16 shows a perspective view of the applicator head of FIG. 9, showing the applying member of the cosmetic applicator in a deformed state.

As seen in FIGS. 13-15, the wing 8*b* is relatively thinner than the support body 8*a*. More particularly, the wing 8*b* is at least 2, 3 times thinner than the support body 8*a*. As a reason, the wing 8*b* is more flexible and elastically bendable, in particular relative to the support body 8*a*. The wing 8*b* is flexible enough to flex during application along contours of the human facial skin or lips so as to provide an even coating of the cosmetic product.

Further, as shown in FIG. 11, a swirl shaped extension 6*e* extends from a distal end portion of the support body 8*a* to the concave front face 9*a* of the wing 8*b* and provides a strength to the wing 8*b* during application. However, the swirl shaped extension 6*e* is an optional feature, the applying member 8 may or may not comprise any such extensions.

Furthermore, a width of the wing 8*b* first increases from a proximal part 15 of the wing 8*b* and forms a widest part W and then gradually decreases from the widest part W to a distal end 13 of the wing 8*b*. A narrow tip 13 is formed at the distal end 13 of the wing 8*b* which coincides with the distal end 13 of the applying member 8. Further, the narrow tip 13 at the distal end allows the user to draw precision lines during application. Further, the narrow tip 13 at the distal end 13 of the applying member 8 may not coincide with the longitudinal axis X of the applying member 8 (refer FIG. 11). More particularly, the narrow tip 13 is off-centered with respect to the longitudinal axis X of the cosmetic applicator 100.

Further, the width of the third lateral face 6*c* of the support body 8*a*, when seen from the left side view of the applying member 8, decreases continuously from a proximal end 12 of the applying member 8 towards a distal portion of the applying member 8, refer FIGS. 12-14. More particularly, the support body 8*a* in a left side view of the applying member 8, has a shape which towards the tip 13 of the applying member 8 is convexly curved and has sloping side edges. The third lateral face 6*c* of the support body 8*a* provides a narrow blending surface to line and blend a cosmetic product for example at corners of lip and eyes.

Figure 17:
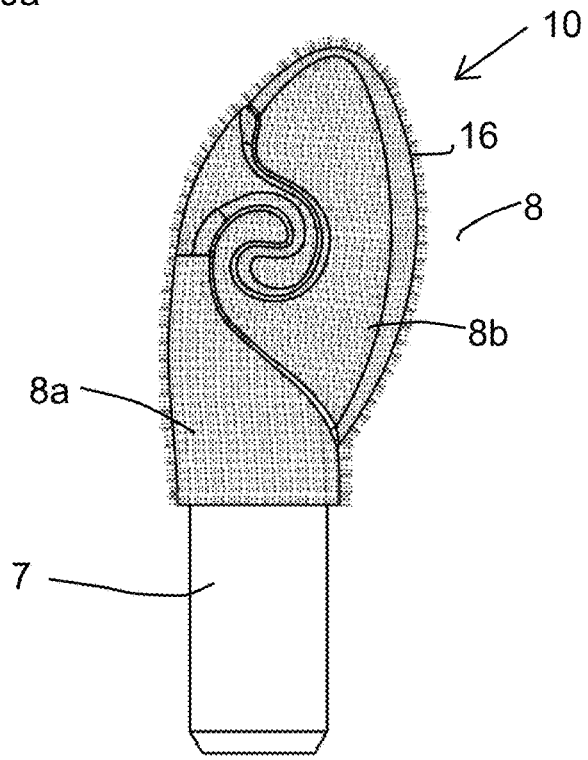
FIG. 17 shows a perspective view of the applicator head of FIG. 11 with flocking on an applying member of the applicator head.

According to an embodiment of the present disclosure, an outer surface of the applying member 8 is covered with application element 16 which in this case is flocked fibers, see FIG. 17. Briefly, the fibers for flocking which may be of any commonly used material, such as nylon, polyester or any natural fiber are applied with an adhesive, such as an epoxy, to the surface to be flocked. The flocking finish to the outer surface of the applying member 8 may be achieved by an appropriately chosen known technique, such as electrostatic flocking. According to an embodiment of the present disclosure, at least one of the wing 8*b* and support body 8*a* may be flocked. According to an alternate embodiment of the present disclosure, the applying member 8 may not be flocked.

At the time of use of said cosmetic package 1, the user first separates the closure 30 from the receptacle 200. In order to apply the cosmetic product onto the keratinous substrate such as skin, lips, eyelids, cheeks, nails or any other part of the body, the cosmetic applicator 100 is dipped into the cosmetic product in the receptacle 200 and then can be applied by the applicator head 10.

Upon withdrawing the cosmetic applicator 100 from the state of being immersed in the cosmetic product (the state shown in FIG. 8), the cosmetic product is picked up and retained on the entire surface of the wing 8*b*. As shown in FIG. 12, a widest part of the applying member 8 lies at the widest part W of the wing 8*b*. The widest part W of the applying member 8 has a larger width than the widest part of the wiper orifice 215. Accordingly, when the cosmetic applicator 100 shown in FIG. 8 is withdrawn from the receptacle 200, the widest part W of the applying member 8 catches in the wiper orifice 215 of the wiper 206. Since the wing 8*b* is made of an elastically deformable material in the present embodiment, it is deformed at the widest part W catching in the wiper orifice 215 so as to be able to pass through the wiper orifice 215.

Refer FIG. 13, the second free lateral edge 9*d* substantially opposite to the joining edge 9*c* joining the wing 8*b* to the support body 8*a*, deform to curl inwardly towards the concave front face 9*a* of the wing 8*b*, where most of the cosmetic is retained. Since the wing 8*b* is curled, the cosmetic product is retained inside the longitudinally concavity 11 while the wing 8*b* is in a deformed state. On the other hand, the convex back surface 9*b* of the wing 8*b* is wiped by the wiper 206 and is deprived of the cosmetic product and acts as a blending surface for easy application of the cosmetic product which is applied by the concave front face 9*a* of the wing 8*b*.

The wiper 206 is made of an elastically deformable material, so that both the wing 8*b* and the wiper orifice 215 are deformed to reduce the resistance against the withdrawal and insertion, whereby the convenience of use is further improved. After the wing 8*b* passes through the wiper orifice 215, it restores the original shape as shown in FIG. 13 with no force by the wiper orifice 215 imposed thereto. Accordingly, as the original shape is restored, the cosmetic product is spread over the entire area of the concave front face 9*a* of the wing 8*b*. As a result, the wing 8*b* is able to apply the cosmetic product uniformly to the lips or any other part of the body.

At this time, there is a very little retention of the cosmetic product on the convex back face 9*b* of the wing 8*b*, so that a user can apply the cosmetic product quickly at ease without feeling worried about unintentional application to other than the target region. The wiper 206 serves to wipe off not only the excess cosmetic product attached to the wing 8*b* but also the cosmetic product attached to the stem 20.

According to an embodiment, the container 10 and the cap 30 may be made of a rigid material like glass, metal, hard plastic or any other material known in the art. However, in alternate embodiments, the container 10 and the cap 30 may be made of a flexible material like flexible polymeric material or any other material known in the art.

According to an embodiment of the present disclosure, at least a part and preferably all of the applicator head 10 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to an embodiment of the present disclosure, the stem 20 presents a cross-section that is circular, but it is not beyond the ambit of the present disclosure for this to be otherwise, in particular when the cross-section of the stem 20 is oval, elliptical or polygonal, e.g. square, triangular or rectangular. The stem 20 can be solid as shown, or, in a variant, it could be hollow.

When the stem 20 is not of circular cross-section, the cap 30 can possibly by fastened on the receptacle 200 by snap-fastening or by some other means, without turning relative to said receptacle 200. The wiper 206 can thus present a non-circular wiper orifice 215 of section that is complementary to the cross-section of the stem 20.

According to an embodiment of the present disclosure, the applicator head 10 can be made, at least in part, from a material that is more flexible than a material from which the stem 20 is made. According to an embodiment, the receptacle 200 and the cap 30 may be made of a rigid material like glass, metal, hard plastic or any other material known in the art. However, in alternate embodiments, the receptacle 200 and the cap 30 may be made of a flexible material like flexible polymeric material or any other material known in the art.

According to an exemplary embodiment shown in FIGS. 9-12, the applying member 8 is elongated along a central longitudinal axis X of the applicator head 10. As seen in FIGS. 8 and 11, the applying member 8 has a longitudinal axis X which is in alignment with a longitudinal axis of the stem 20. The applying member 8 is elongated, that is to say its extent in a direction parallel to the longitudinal axis X is larger than its largest extension perpendicularly to the longitudinal axis X.

Particularly, the largest extension of the applying member 8 in the direction parallel to the longitudinal axis X by at least a factor of 1.5, more preferably is greater by at least a factor of 2 than the greatest extension of the applying member 8 in a direction perpendicular to the longitudinal axis X.

According to an embodiment of the present disclosure, the applicator head 10 and the stem 20 are fitted together by a snap fitment. However, in alternate embodiments, the applicator head 10 and the stem 20 may be fit together by friction fit, by gluing, crimping, magnetic engagement and the like.

According to an embodiment of the present disclosure, the stem 20 can have a longitudinal axis that is rectilinear as shown. In alternate embodiments, the stem is curved.

Figure 18:
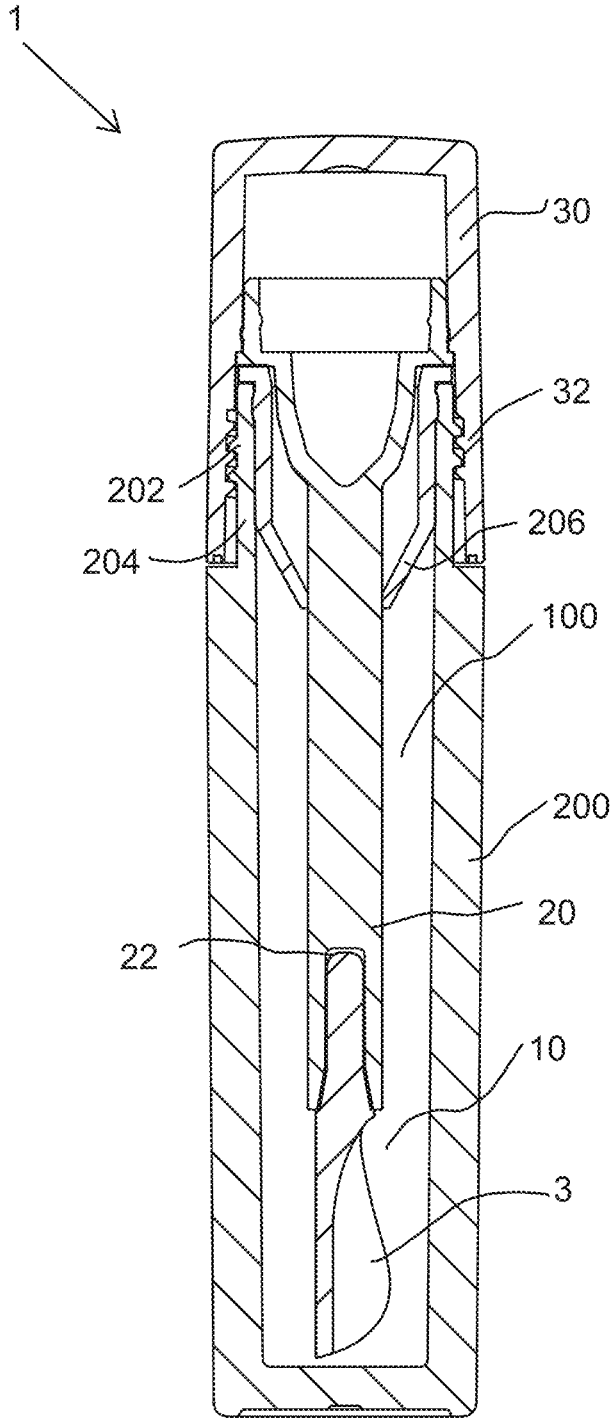
FIG. 18 shows a cross-sectional view of a cosmetic package comprising a cosmetic applicator, according a third embodiment of the present disclosure.

FIG. 18 illustrates a longitudinal sectional view of a cosmetic package 1 according to a third embodiment of the disclosure. As with the similar cosmetic packages disclosed in FIGS. 1, 8, and 24, the cosmetic package 1 comprises a container 200 for holding a product (not shown) and a cosmetic applicator 100. The cosmetic applicator 100 comprises an applicator head 10, a stem 20 and a cap 30. The cap 30 of the applicator 100 has threads 32 which can be screwed onto threads 202, formed on a neck 204 of the container 200. Inserted in the neck 204 of the container 200 is a wiper 206 for wiping off excess product from the cosmetic applicator 100. The distal end of the stem 20 includes an interior longitudinal cavity 22 for receiving and retaining the applicator head 10.

The cosmetic applicator 100 may be used to apply the product (not shown) including a cosmetic or care product. The cosmetic or care product includes viscous cosmetics, mascara, eyebrow powder, lip-gloss, hair color, skin care, under eye cosmetics, pharmaceutical and like products. The applicator head 10 is configured to be loaded with product to be applied.

As shown in FIG. 18, the cosmetic applicator 100 comprises the applicator head 10 retained at a distal end of the stem 20 for applying the product; and the cap 30 at a proximal end of the stem 20.

According to an aspect of the present disclosure, as seen in FIGS. 19-22, a proximal portion of the applicator head 10 is formed as a cylindrical shank 7 which is configured to be received within the cavity 22 of the stem 20. The applicator head 10 is a molded applicator head. The molded applicator head 10 may be fixed to the stem 20 by force fitting, in particular by snapping, gluing, welding or crimping, the shank portion 7 of the application head 10 in the cavity 22 of the stem 20 provided at the distal end of the stem 20.

FIGS. 19-23 show the applicator head 10 according to a further embodiment of the present disclosure. As shown, the applicator head 10 comprises an elongated application body 2 at a distal portion of the applicator head 10, the elongated application body 2 is majorly of U-shaped cross section and of elongate form i.e. a longitudinal U-shaped cavity 3 extends along a longitudinal axis X of the applicator head 10. According to one embodiment, the U-shaped cavity forms a scoop for holding and transporting a quantity of the product.

The application body 2 has a Y axis curve with a concave inner surface 17 and a convex outer surface 5 opposite the inner surface 17. Thus, by Y axis curve, it is meant that the application body 2 is curved in a horizontal axis Y. More particularly, the application body 2 includes at least three vertical sidewalls, namely a first sidewall 2*a*, a second sidewall 2*b* and a third sidewall 2*c*; the three sidewalls together defining the U-shaped cavity 3 among them which is adapted to receive the cosmetic product P. The U-shaped cavity 3 extends from a proximal end to a distal end of the application body 2 and is open at both the proximal and distal ends of the application body 2.

The product P accumulates in said cavity 3 allowing the cosmetic applicator to be used for at least a length of time sufficient to enable the product, such as a cosmetic or a care product, to be applied sufficiently. The first and second sidewalls 2*a*, 2*b* form lateral sides of the U-shaped cavity 3 and the third sidewall form the base of the U-shaped cavity 3. The U-shaped cavity 3 has longitudinal opening 3*a* opposing the third sidewall 2*c*.

Figure 19:
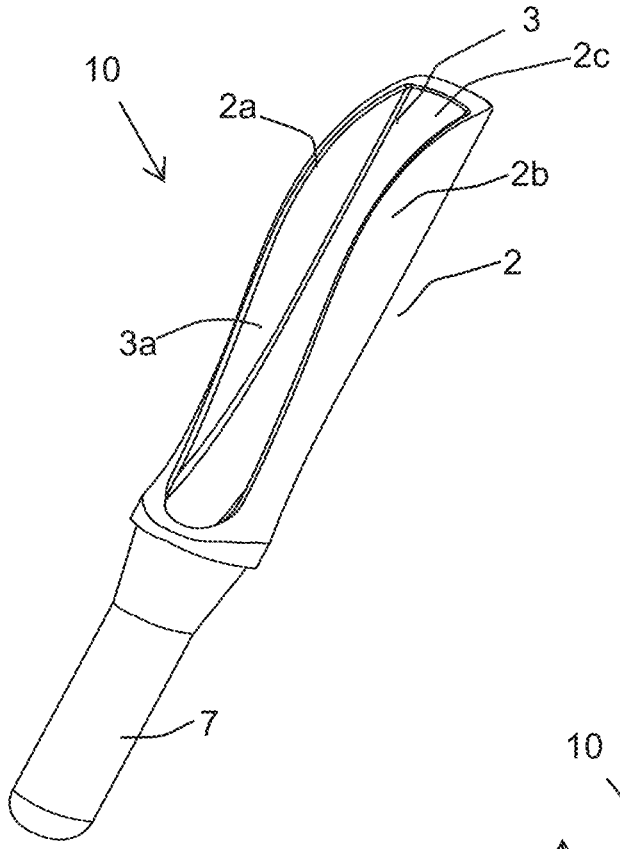
FIG. 19 shows an enlarged perspective view of an applicator head of the cosmetic applicator of FIG. 18.
Figure 23:
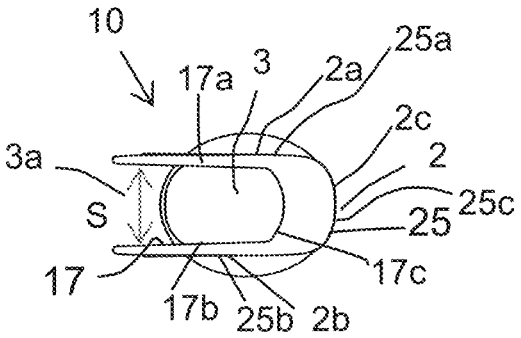
FIG. 23 shows a top view of the applicator head of FIG. 19.

As shown in FIG. 19, the first and second sidewalls 2*a*, 2*b* are two substantially parallel sidewalls of equivalent length, and are horizontally aligned sidewalls 2*a*, 2*b*. The first and second sidewalls 2*a*, 2*b* are substantially parallel and are horizontally spaced so as to form said U-shaped cavity 3 with the connecting sidewall 2*c*. The first and second sidewalls 2*a*, 2*b* extend substantially orthogonal/perpendicularly from the third connecting sidewall 2*c*, as shown in FIGS. 18 and 23.

Figure 24:
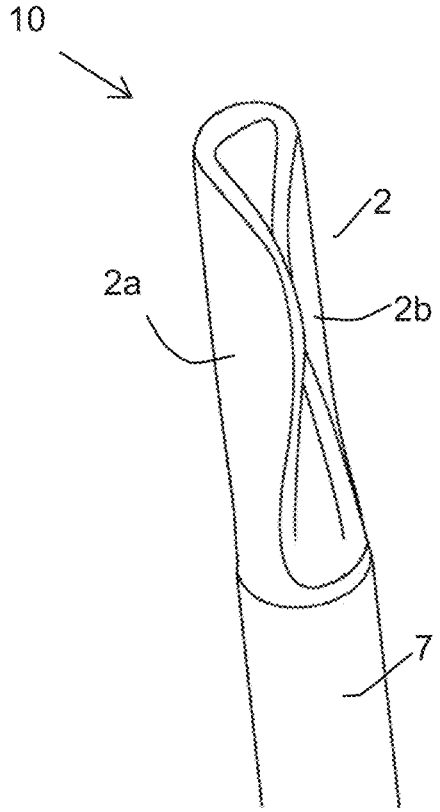
FIG. 24 shows a perspective view of the applicator head of FIG. 19 in a collapsed position.

In variant embodiments, the first and second sidewalls may be of different lengths. According to a further aspect of the present disclosure, as shown in FIG. 24, the first and second sidewalls 2*a*, 2*b* are configured to flex to change their angle to a non-perpendicular angle with respect to the third sidewall 2*c*, under influence of external forces.

According to a further aspect of the present disclosure, the first and second sidewalls 2*a*, 2*b* are integral with the third sidewall 2*c*.

According to a further aspect of the present disclosure, a distance between opposing inner surfaces 17*a*, 17*b* of the first and second sidewalls 2*a*, 2*b* define a span S significantly less than the length of the first and second sidewalls 2*a*, 2*b* or the third sidewall 2*c*. In preferred embodiment, the span S being at least 2 times less than the length of the application body 2, more preferably at least 3 times less than the length of the application body 2, even more preferably at least 5 times less than the length of the application body 2.

In the exemplary embodiment, as shown in FIGS. 19 and 23, each of said first and second sidewalls 2*a*, 2*b* has a generally uniform thickness and substantially flat vertical outer surfaces 25*a*, 25*b* and inner surface 17*a*, 17*b* respectively. The third sidewall 2*c* has a thickness greater than the thickness of the first and second sidewalls 2*a*, 2*b*. Further, an outer surface 25*c* and an inner surface 17*c* of the third sidewall 2*c* are curved surfaces. The outer surface 25*a*, 25*b* of each of the sidewalls 2*a*, 2*b* forms a curved and smooth corner with said outer surface 25*c* of third sidewall 2*c*. Thus, a corner thickness is substantially greater than the uniform thickness of said first and second sidewalls 2*a*, 2*b*.

According to a further aspect of the present embodiment, the first and second sidewalls 2*a*, 2*b* act like two flexible flaps that extends transversally from the third sidewall 2*c* along substantially the entire length of the application body 2. During use, the flexible flaps 2*a*, 2*b* flex inwardly towards the third sidewall 2*c* during application to release the cosmetic product from the opening 3*a* of the U-shaped cavity 3.

According to a further aspect of the present embodiment, the first and second sidewalls 2*a*, 2*b* are configured to be folded relative to the third sidewall 2*c* between a collapsed state and a rested state, as shown in FIGS. 24 and 19 respectively.

In the rested state as shown in FIG. 19, the first and second sidewalls 2*a*, 2*b* extend in substantially parallel directions and substantially orthogonal/perpendicularly from the third sidewall 2*c*. In the collapsed sate, the first and second sidewalls 2*a*, 2*b* flex to collapse inwardly towards the third sidewall 2*c* and change their angle to a non-perpendicular angle with respect to the third sidewall 2*c*.

According to the disclosure, the thickness, the material, and/or the connection of the first and second sidewalls 2*a*, 2*b* to the third sidewall 2*c* are selected such that the first and second sidewalls 2*a*, 2*b* may flex/pivot with respect to the third sidewall 2*c*. More particularly, the first and second sidewalls 2*a*, 2*b* fold inwardly towards the inner surface 7*c* of the third sidewall 2*c* such that they abut each other and form a partially collapsed folded structure.

More particularly, when the application body 2 is under the influence of the external forces that are exerted on the application body 2 by the wiper and/or the neck of the container, the first and second sidewalls 2*a*, 2*b* flex/pivot inwardly towards the inner surface 17*c* of the third sidewall 2*c* to form a partially collapsed folded structure and wherein the first and second sidewalls 2*a*, 2*b* abut each other in the collapsed state. The external forces are exerted on the application body 2 by the wiper and/or the neck of the container, when the application body 2 is pulled out as intended by the wiper 206 or the container neck or thrust back into the container again in the reverse direction. Further, when the force on the application body 2 is removed, the first and second sidewall 2*a*, 2*b* move back to their original state where the first and second sidewalls 2*a*, 2*b* are substantially perpendicular to the third sidewall 2*c*.

According to yet another aspect of the present embodiment, the longitudinal U-shaped cavity 3 of the application body 2 helps retaining cosmetic product P which is available for loading, transporting and applying after wiping of the applicator head 10.

The term "substantially perpendicular" includes the meaning that there is a slight variation from a particular direction. More particularly, the term "substantially perpendicular" means perpendicular state with a deviation of less than 10°. The term substantially parallel" includes the meaning that there is a slight variation from the parallel direction. In other words, two objects or axis are at least 5 degrees or 10 degrees within the parallelism (Five or ten degrees of parallel), it means extending parallel to each other.

The term "proximal" designates the side toward the later cap 30 or the shank 4, while the term "distal" designates the side facing correspondingly away.

According to an aspect of the present disclosure, the applicator head 10 may not be flocked, as shown in FIGS. 18 to 24.

Figure 25:
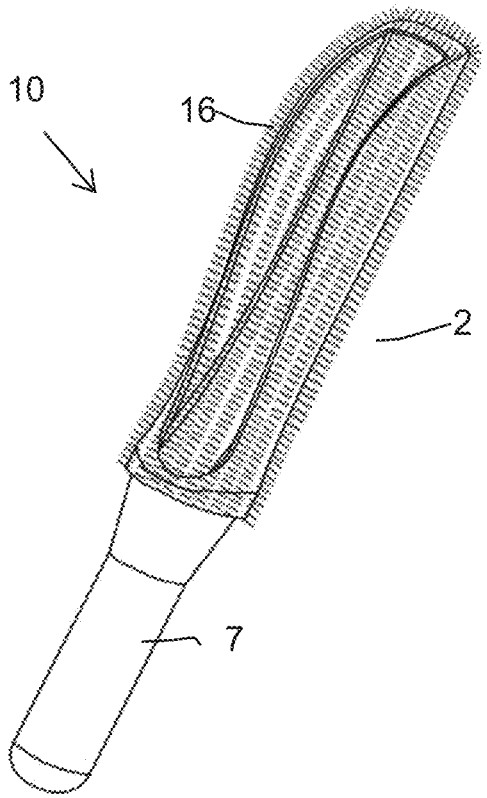
FIG. 25 shows an isometric view of the applicator head of FIG. 19, with flocking.

According to yet another aspect of the present disclosure, as seen in FIG. 25, the application body 2 of the applicator head 10 may have application elements 16 on at least a portion of the inner or outer surface or at least on one of the three sidewalls 2*a*, 2*b*, 2*c*. The application elements 16 may be selected from a group of tines, flocking, a texture surface and the like.

As seen in FIG. 25, the application elements 16 are flocking. The flocking can be implemented on a portion of the application body 2 mechanically, electrostatically or by a combination of both technologies. In variant embodiments, the application elements may be projections, bristles, tines, particles, ribs, grooves, discs, slits, cuts, holes, dimples, foam or other surface features or surface treatments (e.g., abrading) that are suitable for combing and/or loading, transporting and applying cosmetic product such as, for example, mascara, eyeshadow etc.

Figure 20:
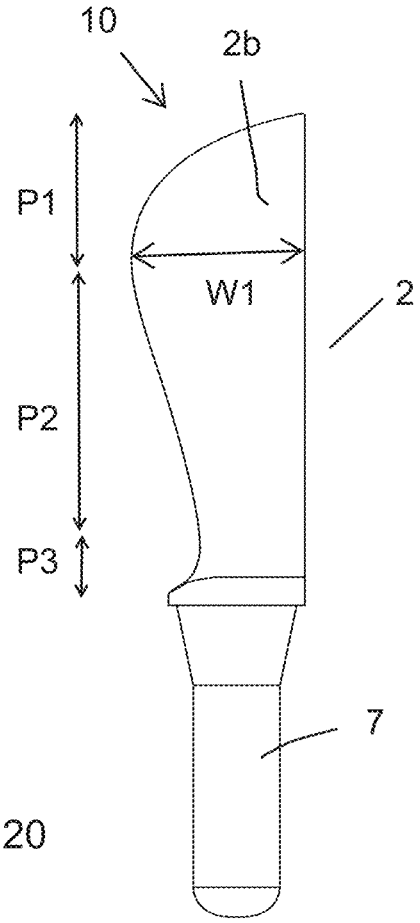
FIG. 20 shows a left-side view of the applicator head of FIG. 19.
Figure 21:
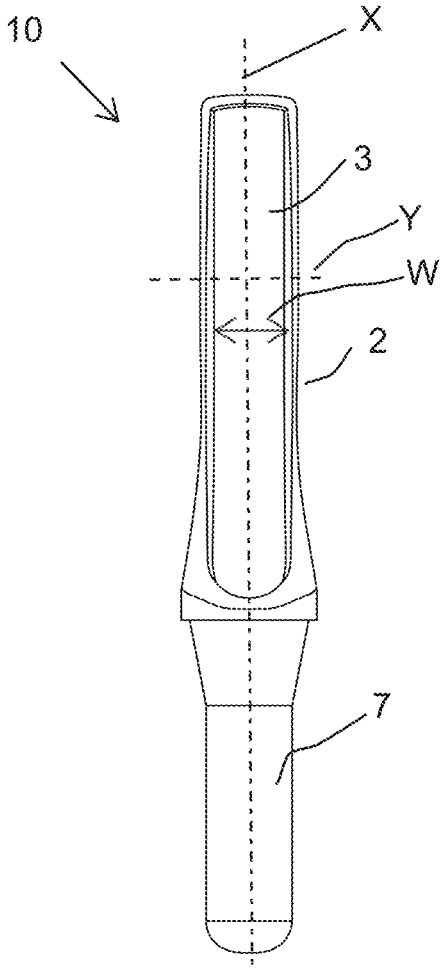
FIG. 21 shows a front view of the applicator head of FIG. 19.
Figure 22:
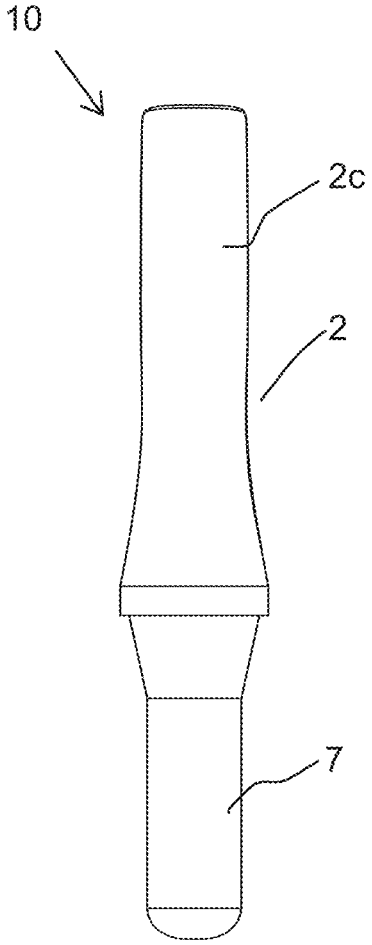
FIG. 22 shows a rear view of the applicator head of FIG. 19.

According to yet another aspect of the present embodiment, each of the first and second sidewalls 2*a*, 2*b* has a greatest width W1 greater than a greatest width W of the third sidewall 2*c*, as shown in FIGS. 20-21. According to yet another aspect of the present embodiment, each of the first and second sidewalls 2*a*, 2*b* has a width that varies along the longitudinal axis of the application body 2, see FIG. 20. More particularly, the width of the first and second sidewalls 2*a*, 2*b* first increase from a distal end to up to a first portion P1 of a length of the application body 2, then decreases to up to a second portion P2 of the length of the application body 2 and then again increases to up to a third portion P3 of the length of the application body 2.

As seen in FIG. 20, the length of the second portion P2 is greater than the length of the first portion P1 and the length of the third portion P3; and the length of the first portion P1 is greater than the length of the third portion P3.

Further, as seen in FIG. 19, free edges of the each of the first and second sidewalls 2*a*, 2*b* include a convex curve extending in the distal portion, the convex curve is followed by a straight edge in the middle portion; and the straight edge is followed by a concave curve near the proximal end of the first and second sidewalls 2*a*, 2*b* respectively.

In variant embodiments, the application body 2 may have a substantially C-shaped transverse cross-section and C-shaped longitudinal cavity.

According to an embodiment of the present disclosure, the application body 2 may be fabricated from a material selected from a group consisting of elastomeric or deformable plastic, rubber, sintered or porous material and/or combinations thereof.

The applicator head 10 according to the disclosure can be manufactured in a single injection-molding step. The first and second sidewalls 2*a*, 2*b* must be sufficiently thin, so that even if no soft elastic plastic is used, the first and second sidewalls 2*a*, 2*b* may be able to flex and enfold a spring effect.

More particularly, at least a part and preferably all of the applicator head 10 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

Figure 26:
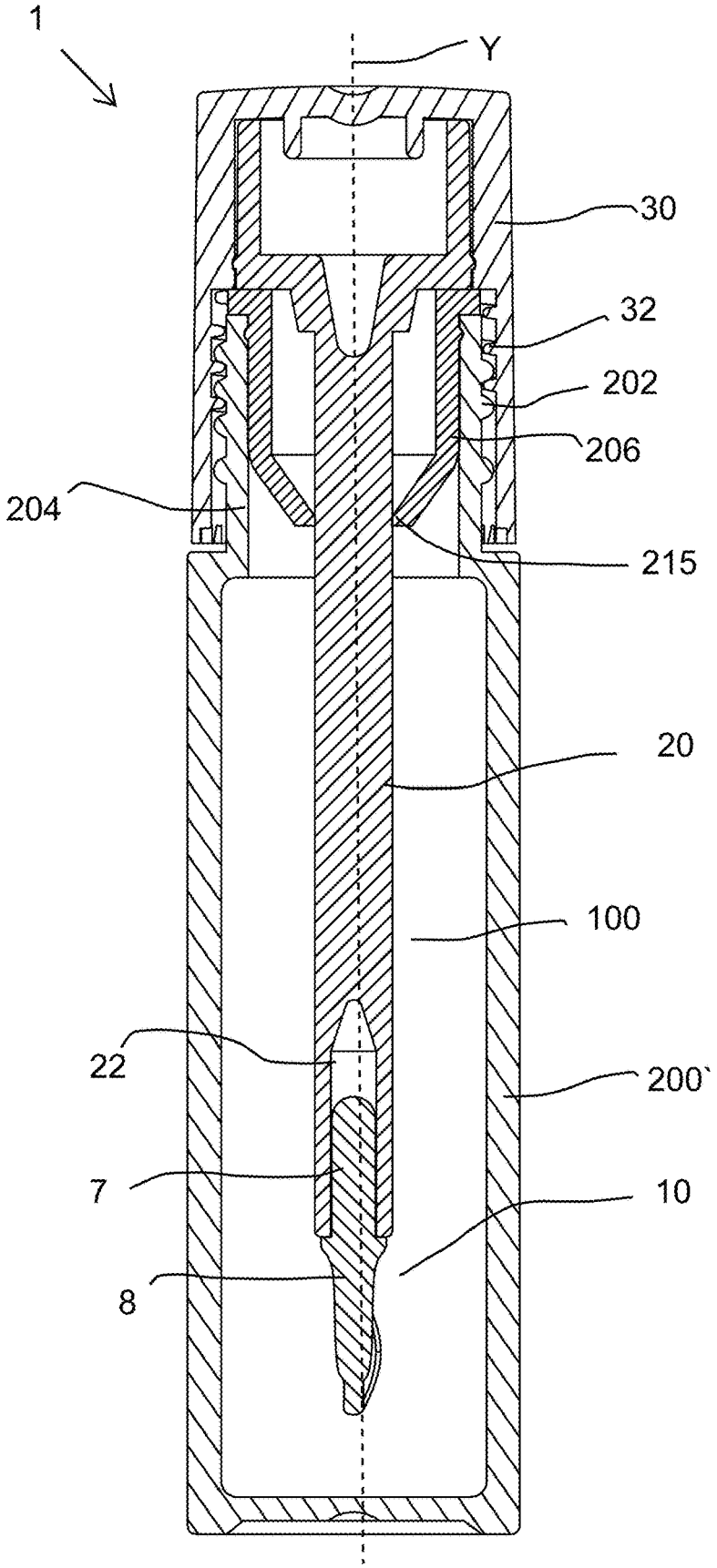
FIG. 26 shows a cross-sectional view of a cosmetic package equipped with a cosmetic applicator of a fourth embodiment of present disclosure.

FIG. 26 illustrates a longitudinal sectional view of a cosmetic package 1 including an applicator 100 according to a fourth embodiment of the disclosure. The cosmetic package 1, which is similar to the packages discussed with regard to FIGS. 1, 8, and 18, comprises a receptacle 200 for holding a product (not shown) and a cosmetic applicator 100. The cosmetic applicator 100 comprises an applicator head 10, a stem 20, and a cap 30. The cap 30 of the cosmetic applicator 100 has threads 32 which can be screwed onto threads 202, formed on a neck 204 of the receptacle 200.

The applicator head 10 retained at a distal end of the stem 20 for applying the product; and the cap 30 at a proximal end of the stem 20. In general, the use of the terms "distal" and "proximal" herein is supposed to mean that the distal side/end is the side/end facing towards the inside of the storage receptacle 200, whereas the proximal side or proximal end is the side or end facing towards the removal opening of the receptacle 200. Further, the distal end of the stem 20 includes an interior longitudinal cavity 22 for receiving and retaining the applicator head 10.

Inserted in the neck 204 of the receptacle 200 is a wiper 206 for wiping off excess product from the cosmetic applicator 100. Further, the wiper 206 comprises a wiping orifice 215. Further, the applicator head 10 of cosmetic applicator 100 may be used to apply the product including a cosmetic or care product. The cosmetic or care product includes viscous cosmetics, mascara, eyebrow powder, lip gloss, hair color, skin care, under eye cosmetics, pharmaceutical and like products.

Figure 27:
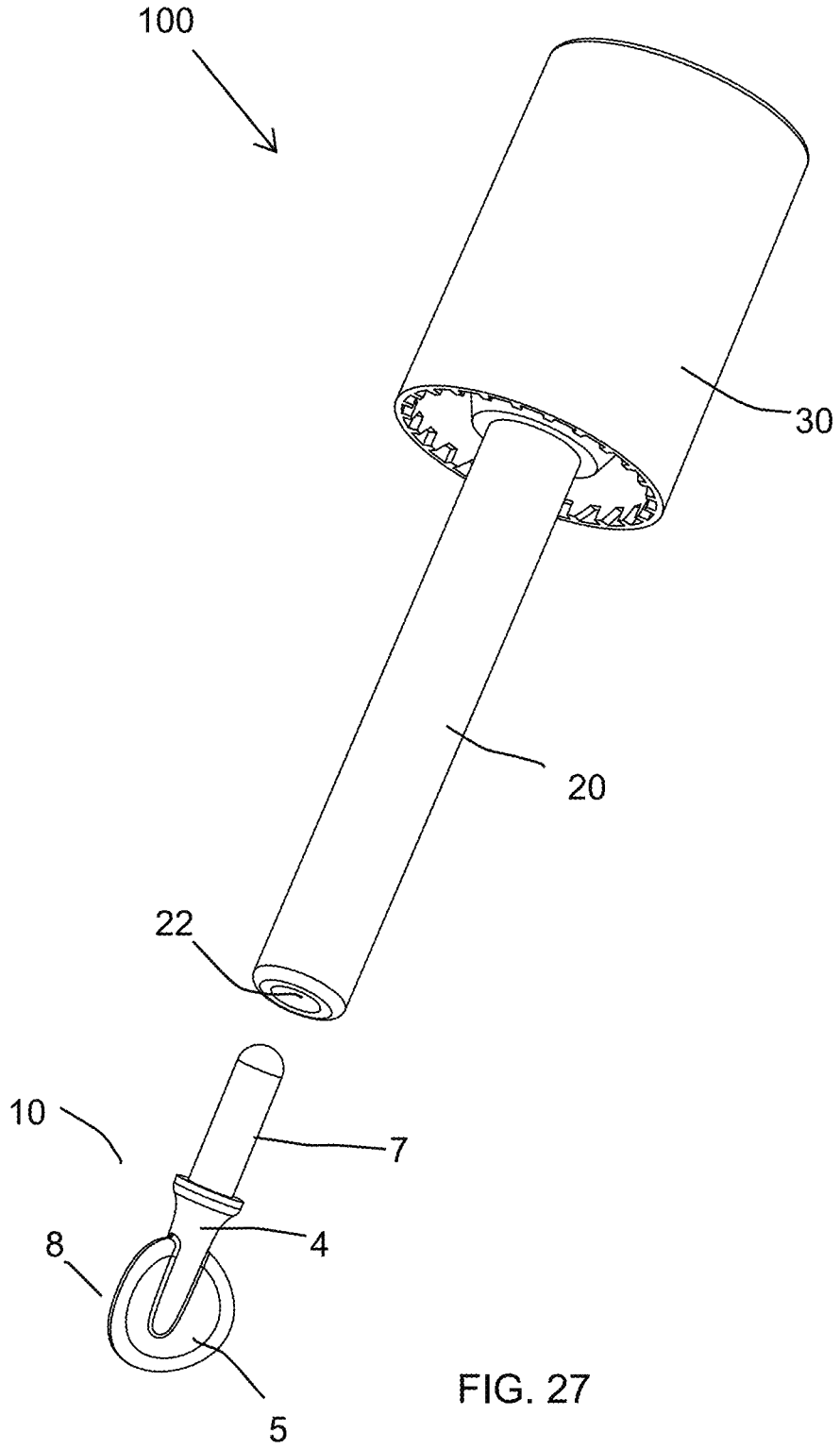
FIG. 27 shows an exploded view of the cosmetic applicator of the cosmetic package of FIG. 26.
Figure 28:
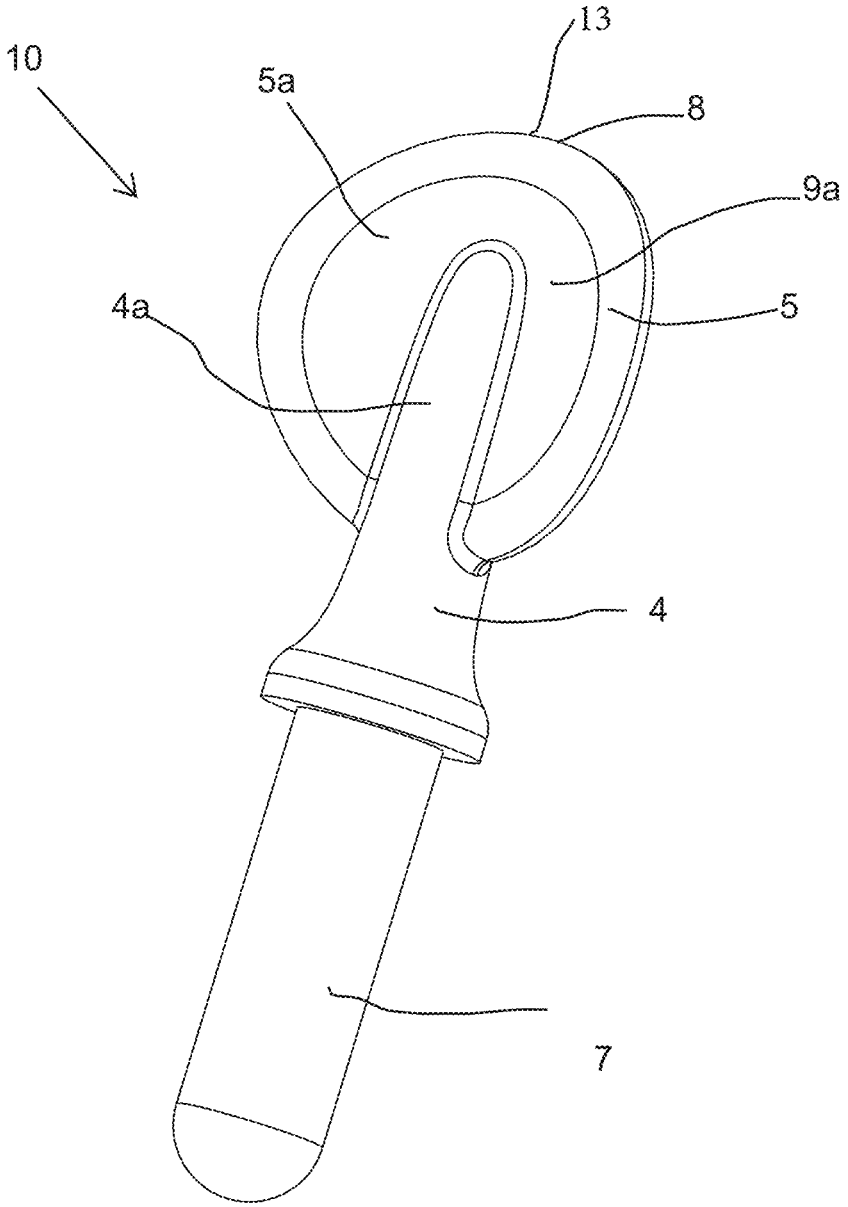
FIG. 28 shows a perspective view of an applicator head of the cosmetic applicator of FIG. 27.

As shown in FIGS. 26-28, the applicator head 10 comprises an applying member 8 at its distal portion and a shank member 7 at its proximal portion. The shank member 7 is configured to be received and retained within the cavity 22 of the stem 20.

Figure 29:
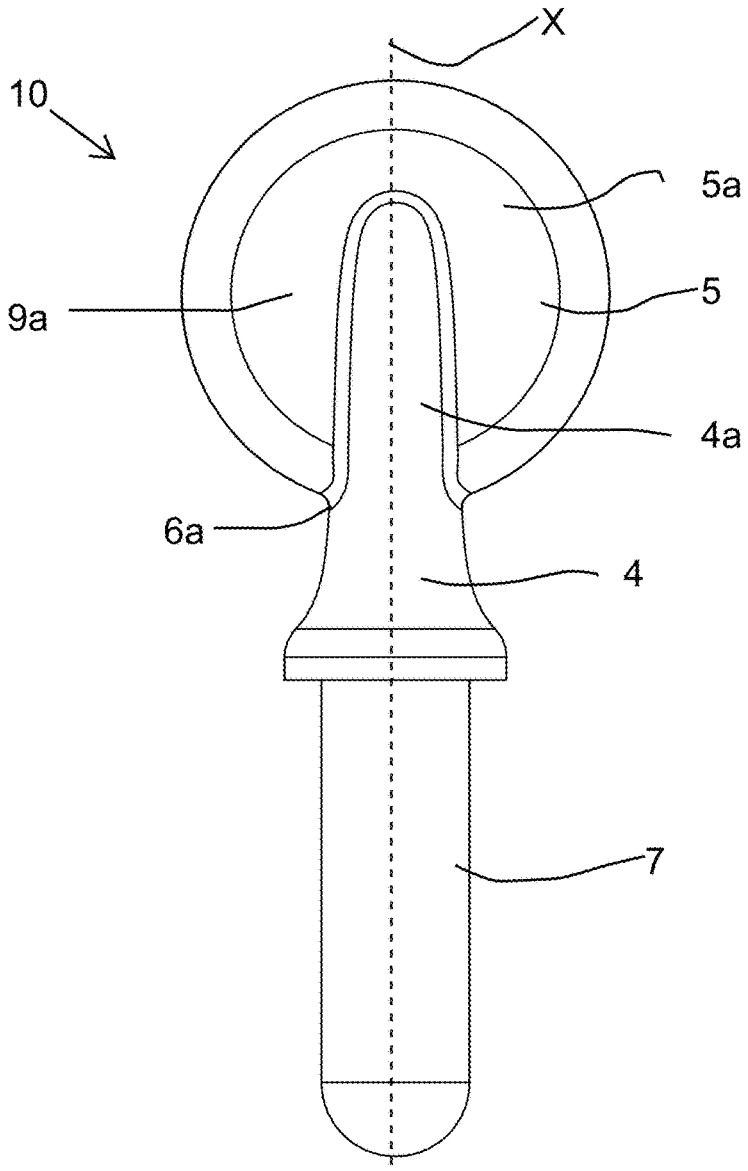
FIG. 29 shows a front view of the applicator head of FIG. 27.

According to an exemplary embodiment shown in FIGS. 27-30, the applying member 8 is elongated along a central longitudinal axis X of the applicator head 10. As seen in FIGS. 26 and 29, the applying member 8 has a longitudinal axis X which is in alignment with a longitudinal axis Y of the stem 22. The applying member 8 is elongated, that is to say its extent in a direction parallel to the longitudinal axis X is larger than its largest extension perpendicularly to the longitudinal axis X.

Particularly, the largest extension of the applying member 8 in the direction parallel to the longitudinal axis X by at least a factor of 1.5, more preferably is greater by at least a factor of 2 than the greatest extension of the applying member 8 in a direction perpendicular to the longitudinal axis X.

Referring to FIGS. 26-33, shows an applicator head 10 according to a still further embodiment of the present disclosure. The applying member 8 of the applicator head 10 comprises a columnar root portion 4 that forms a base of applying member 8 and a circular wing 5 extending from a distal end 6*a* of the columnar root portion 4. The circular wing 5 is constituted by a circular plate-shaped structure which is curved in a plane perpendicular to the longitudinal axis X of the applying member 8.

The columnar root portion 4 reduces gradually in thickness and width from a proximal end of the applying member 8 to a proximal end of the circular wing 5. According to an aspect of the present disclosure, as shown in FIGS. 27-28, the circular wing 5 has a diameter such that the circular wing 5 projects outward beyond an outer diameter of the columnar root portion 4 and an outer diameter of the stem 20.

By forming the circular wing 5 in a wide and curved plate shape, a sufficient amount of the cosmetic product can be scooped up, and the cosmetic can easily be applied widely over an application surface.

According to an aspect of the present disclosure, the shank portion 7 inserted fixedly into the stem 20 is molded integrally with the applying member 8. As shown in FIG. 28, the circular wing 5 defines a distal end 13 of the applying member 8.

As seen in FIGS. 28-32, the circular wing 5 defines at least two main application faces opposite to each other, namely a first application face 5*a* and a second application face 5*b* opposite to the first application face 5*a*. At least one of the first application face 5*a* and the second application face 5*b* is concave, more particularly, as seen in FIG. 29, the first application face 5*a* has a concave outer surface 9*a* and the second application face 5*b* has a convex outer surface 9*b*.

Referring to FIGS. 28-32, the root portion 4 has two extensions that extend from a distal end 6*a* of the root portion 4, namely a first extension 4*a* and a second extension 4*b* that extend longitudinally in opposite directions on respective the first application face 5*a* and the second application face 5*b* of the circular wing 5, along the longitudinal axis X of the applying member 10. Each of the first and second extensions 4*a*, 4*b* extends along a longitudinal direction from a root portion 4 of the applying member 8 to up to at least a half a length of the respective faces the first application face 5*a* and the second application face 5*b*.

According to an aspect of the present disclosure, the first and second extensions 4*a*, 4*b* define a rigid region on the applying member 8 that provides bending resistance during application. A portion of the circular wing 5 which is free from the first and second extensions 4*a*, 4*b* defines a flexible region which is flexible enough to flex and adjust according to contour of the application surface, thus allowing even and smooth application of the product during application.

Figure 30:
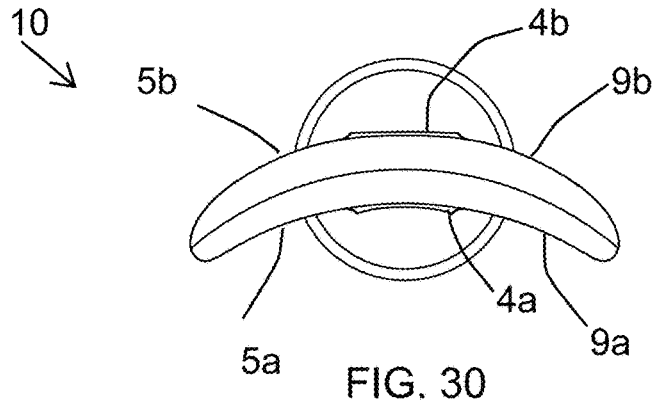
FIG. 30 shows a top view of the applicator head of FIG. 27.
Figure 32:
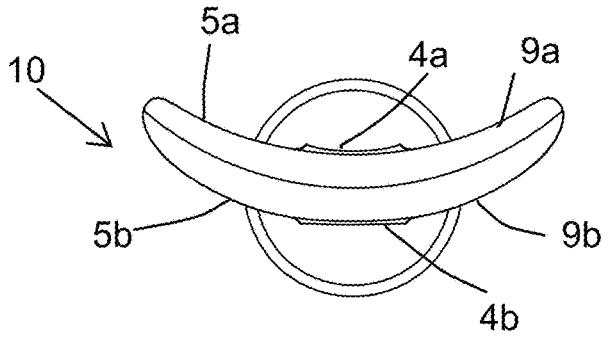
FIG. 32 shows a top view of the applicator head of FIG. 27.
Figure 31:
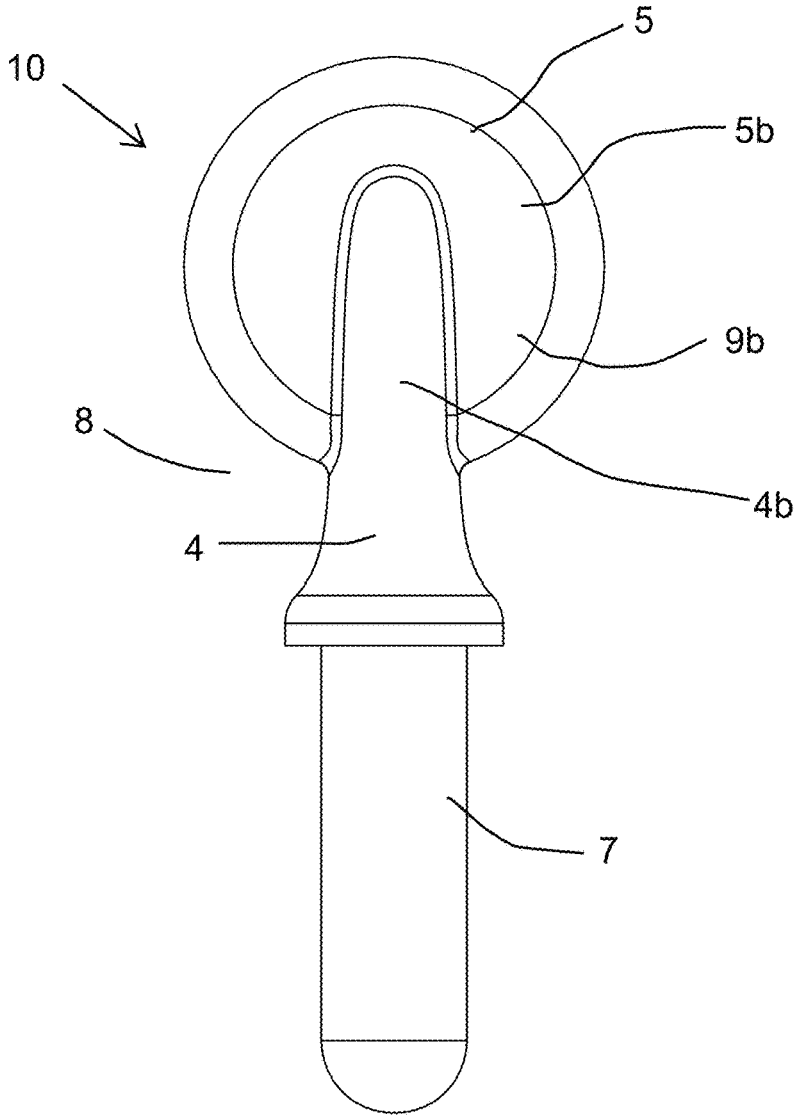
FIG. 31 shows a back view of the applicator head of FIG. 27.
Figure 33:
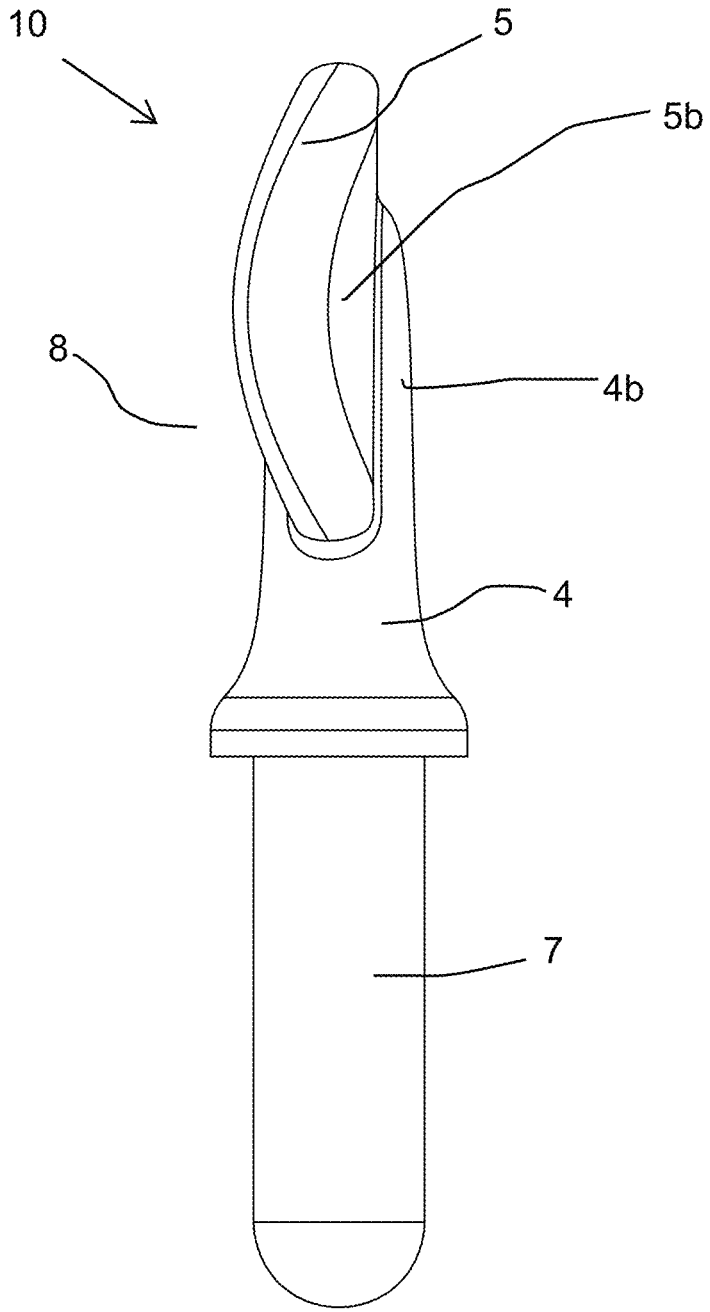
FIG. 33 shows a side view of the applicator head of FIG. 27.
Figure 36:
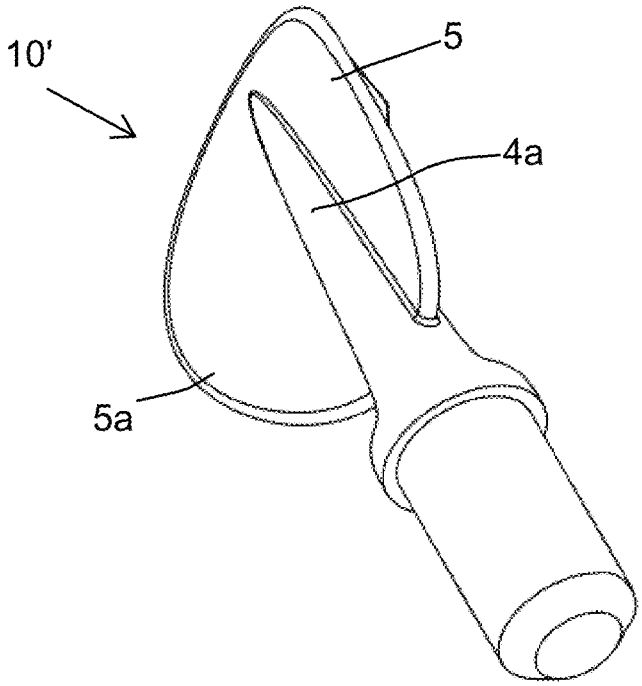
FIG. 36 shows a perspective of an applicator head according to a fifth embodiment of the present disclosure.
Figure 37:
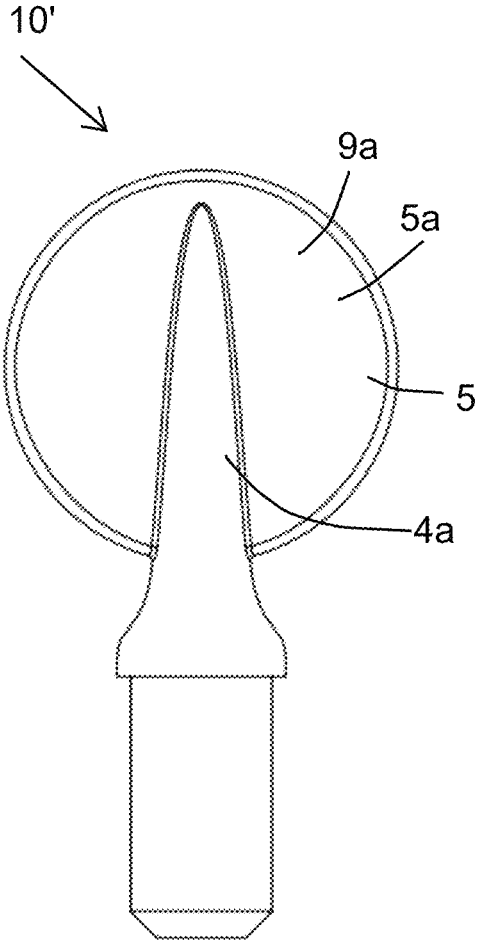
FIG. 37 shows a front view of the applicator head of FIG. 36.
Figure 38:
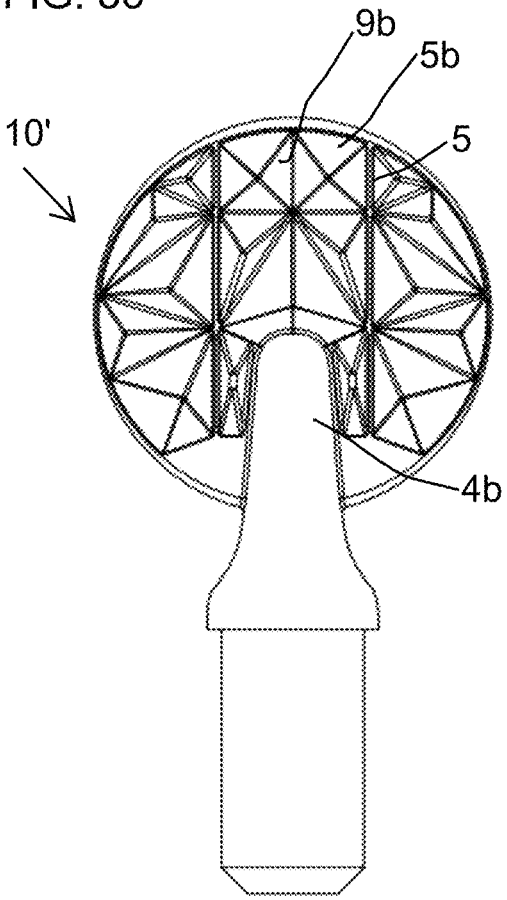
FIG. 38 shows a back view of the applicator head of FIG. 36.

According to exemplary embodiment shown in FIGS. 30-32, the first and second extensions 4*a*, 4*b* are identical in shape and dimensions, and extend parallel to each other over their entire length. However, in an alternate embodiment, the first and second extensions 4*a*, 4*b* may not be identical in shape and dimensions and may or may not extend in parallel directions. For example, in a still further embodiment of the applicator head 10 according present disclosure, and an applicator head 10' as shown in FIGS. 36-38, the first and second extensions 4*a*, 4*b* are of non-identical shapes and have different lengths along a longitudinal direction of the applying member 8.

According to an aspect of the present disclosure, a length of each of the first and second extensions 4*a*, 4*b* is about at least 40% of a total length of the circular wing 5 but less than 95% of the length of the circular wing 5. Preferably, the total length each of the first and second extensions 4*a*, 4*b* is longer than its width, for example several times larger than its width.

The first and second extensions 4*a*, 4*b* may have any geometric cross-section, and may be, e.g., a rounded or have a rectangular, triangular, square, or an irregular cross-section.

The circular wing 5 is flexible enough to flex during application along contours of the human facial skin or lips so as to provide an even coating of the cosmetic product. The applying member 8 picks up generous amount of product in the concavity of the first application face 5*a*.

Figure 35:
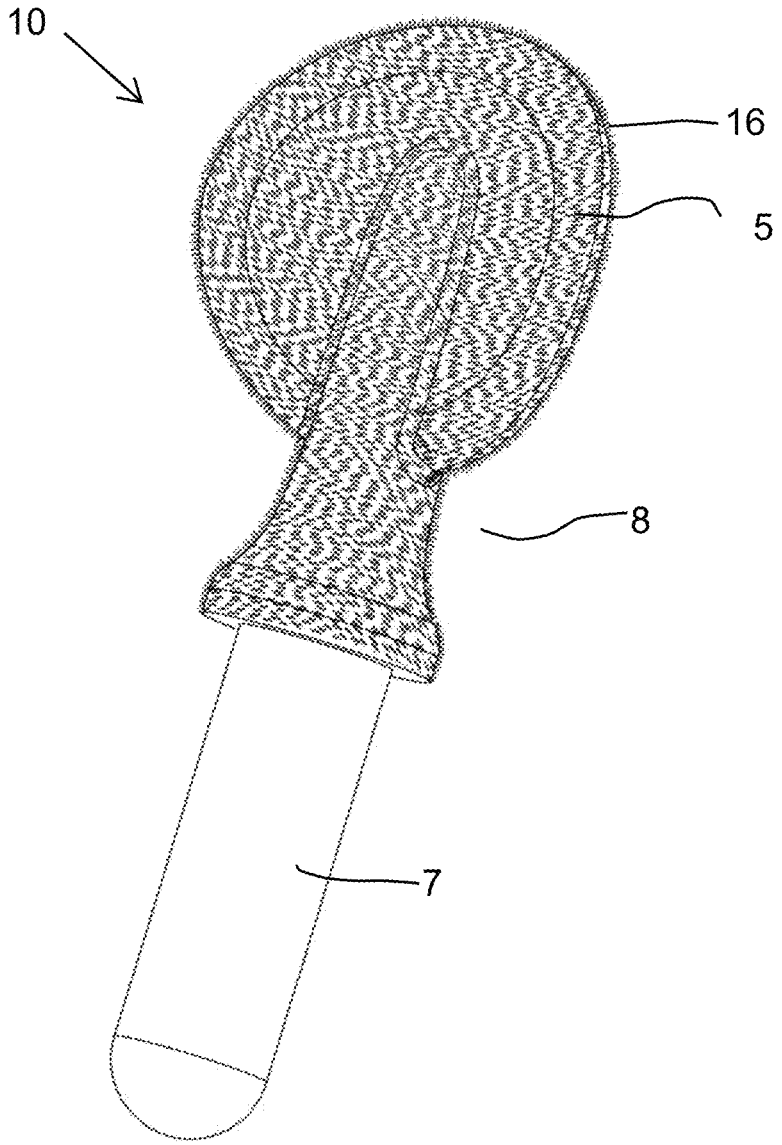
FIG. 35 shows a perspective view of an applicator head of the cosmetic applicator of FIG. 27 with flocking on an applying member of the applicator head.

According to an embodiment of the present disclosure, an outer surface of the applying member 8 is covered with application element 16 which in this case is flocked fibers 16, refer FIG. 35. Briefly, the fibers 16 for flocking which may be of any commonly used material, such as nylon, polyester or any natural fiber are applied with an adhesive, such as an epoxy, to the surface to be flocked.

The flocking finish to the outer surface of the applying member 8 may be achieved by an appropriately chosen known technique, such as electrostatic flocking. The applying member 8 may be flocked over substantially its entire visible surface. In a variant, at least one of the first and second 4 extensions 4*a*, 4*b* of the applying member 8 may be flocked. In yet another variant, only the circular wing 5 that is used for applying the composition may be flocked.

According to an aspect of the present disclosure, the circular wing 5 may have a smooth or a rough surface, before flocking. Preferably, at least one of the first application face 5*a* or the second application face 5*b* has a textured surface.

According to a variant embodiment of the present disclosure, as shown in FIGS. 36-38, the circular wing 5 has a massaging texture on the convex surface 9*b* of the second application face 5*b* for skin stimulation and enhanced absorption of the cosmetic product, and whereas the first application face 5*a* has a concave surface for smooth application of the cosmetic product. The massaging texture includes a faceted surface.

Figure 34:
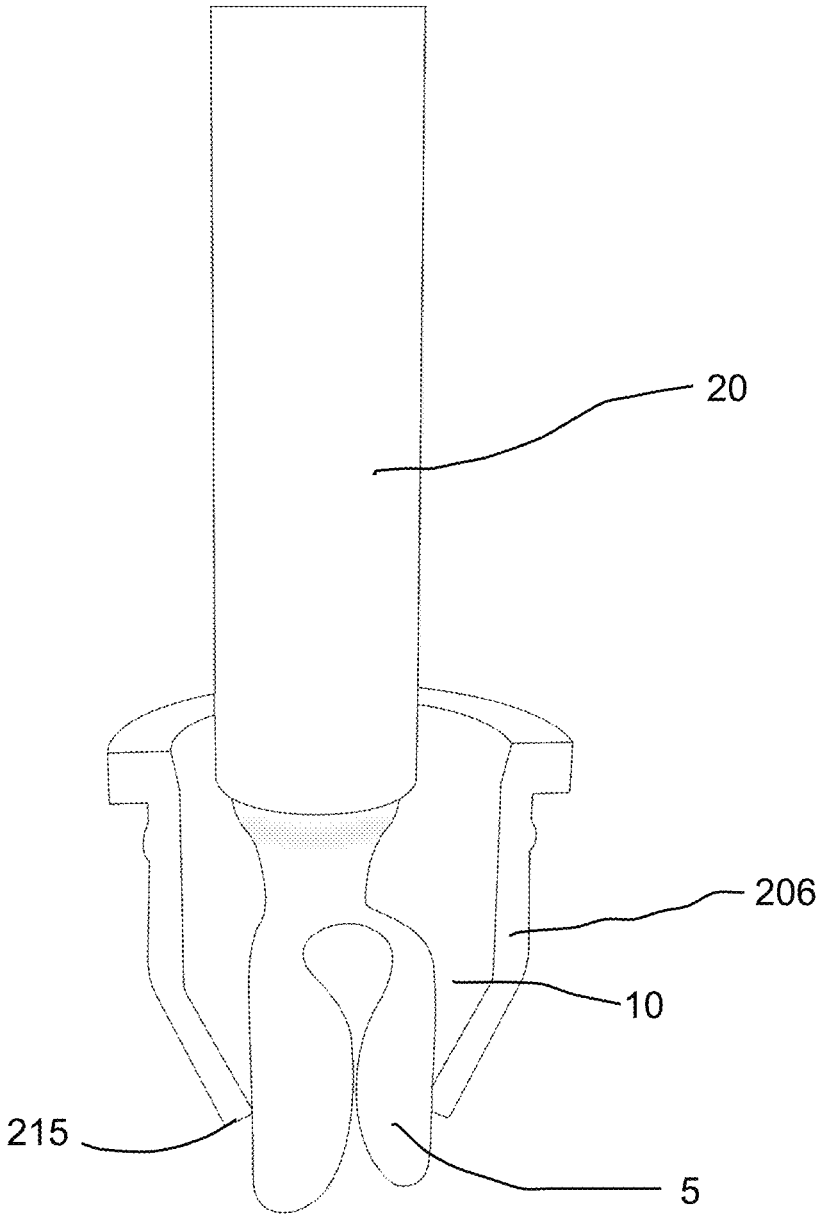
FIG. 34 shows a perspective view of the applicator head of FIG. 27 in deformed state when the applicator head is being wiped using a wiper of the cosmetic package of FIG. 26.

Upon withdrawing the cosmetic applicator 100 from the state of being immersed in the cosmetic product (the state shown in FIG. 26), the cosmetic product is picked up and retained on the entire surface of the circular wing 5 due to flocking 11. As shown in FIG. 26, the widest part of the circular wing 5 has a larger width than the widest part of the wiper orifice 215. Accordingly, when the cosmetic applicator 100 shown in FIG. 26 is withdrawn from the receptacle 200, the widest part of the circular wing 5 catches in the wiper orifice 215 of the wiper 206, refer FIG. 34. Since, the circular wing 5 is made of an elastically deformable material in the present embodiment, it is deformed at the widest part catching in the wiper orifice 215 so as to be able to pass through the wiper orifice 215.

Since the first application face 5*a* of the circular wing 5, where most of the cosmetic product is retained, has the concave outer surface 9*a*, the circular wing 5 is curled into a substantial C-shape. Since the circular wing 5 is curled into the substantially C-shape, the cosmetic product remains retained inside the C-shape while the circular wing 5 is in a deformed state. On the other hand, the second application face 5*b* has the convex outer surface and is wiped by the wiper 206. The second application face 5*b* is wiped more and acts as a blending surface for easy application of the cosmetic product which is applied by the first application face 5*a* of the circular wing 5.

According to an aspect of the present disclosure, the wiper 206 is made of an elastically deformable material, so that both the circular wing 5 and the wiper orifice 215 are deformed to reduce the resistance against the withdrawal and insertion, whereby the convenience of use is further improved.

After the circular wing 5 passes through the wiper orifice 215, it restores the original shape as shown in FIG. 29 with no force by the wiper orifice 215 imposed thereto. Accordingly, as the original shape is restored, the cosmetic product is spread over the entire area of the first application face 5*a* of the circular wing 5. As a result, the circular wing 5 is able to apply the cosmetic product uniformly to the lips or any other part of the body. At this time, there is very little retention of the cosmetic product on the second application face 5*b* of the circular wing 5, so that a user can apply the cosmetic product quickly at ease without feeling worried about unintentional application to other than the target region. The wiper 206 serves to wipe off not only the excess cosmetic product attached to the circular wing 5 but also the cosmetic product attached to the stem 20.

According to an embodiment, the container 10 and the cap 30 may be made of a rigid material like glass, metal, hard plastic or any other material known in the art. However, in alternate embodiments, the container 10 and the cap 30 may be made of a flexible material like flexible polymeric material or any other material known in the art.

According to an embodiment of the present disclosure, at least a part and preferably all of the applicator head 10 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to an embodiment of the present disclosure, the stem 20 presents a cross-section that is circular, but it is not beyond the ambit of the present disclosure for this to be otherwise, in particular when the cross-section of the stem 20 is oval, elliptical or polygonal, e.g. square, triangular or rectangular. The stem 20 can be solid as shown, or, in a variant, it could be hollow. When the stem 20 is not of circular cross-section, the cap 30 is fastened on the receptacle 200 by snap-fastening or by some other means, without turning relative to said receptacle 200. The wiper 206 can thus present a non-circular wiper orifice 215 of section that is complementary to the cross-section of the stem 20.

According to an embodiment of the present disclosure, the applicator head 10 is made, at least in part, from a material that is more flexible than a material from which the stem 20 is made. According to an embodiment, the receptacle 200 and the cap 30 is made of a rigid material like glass, metal, hard plastic or any other material known in the art. In alternate embodiments, the receptacle 200 and the cap 30 is made of a flexible material like flexible polymeric material or any other material known in the art.

According to an embodiment of the present disclosure, the applicator head 10 and the stem 20 are fitted together by a snap fitment. However, in alternate embodiments, the applicator head 10 and the stem 20 are fit together by friction fit, by gluing, crimping, magnetic engagement and the like. According to an embodiment of the present disclosure, the stem 20 has a longitudinal axis Y that is rectilinear as shown. In alternate embodiments, the stem is curved.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A system for applying a substance to a keratinous surface comprising:

a container for holding the substance;

a wiper disposed across an opening of the container, the wiper comprising an orifice;

an applicator comprising a shaft and an applicator head, the shaft and applicator head sized and configured to movably pass through the orifice along a longitudinal axis, the applicator head comprising:

a shank joining a proximal portion of the applicator head with a distal portion of the shaft;

a root connected with a distal end of the shank; and a spatula extending in a distal direction from the root comprising one or more deformable portions, wherein the deformable portions have a dimension traverse to the longitudinal axis greater than a diameter of the orifice, wherein the deformable portions flex when drawn through the orifice so that the spatula defines a reservoir, wherein, when the shaft is extended through the orifice and the applicator head is immersed in the substance, the substance adheres to the spatula, wherein, when the shaft and applicator head are withdrawn from the container in a proximal direction, the deformable portions flex to define the reservoir, wherein a quantity of the substance is carried in the reservoir, wherein the deformable portions comprise:

a first opposing curved edge comprising a first convex section adjoining the root and a first concave section continuous with, and distal of, the first convex section, a second opposing curved edge comprising a second concave section and a second convex section continuous with, and distal of, the second concave section, and a tip continuous with the first concave section and the second convex section and formed at a distal end of the spatula by the distal ends of the first concave section and the second convex section.

2. The system of claim 1, wherein the spatula further comprises a flocked surface, the flocked surface covering at least a portion of the spatula.

3. The system of claim 1, wherein the spatula comprises a concave internal surface between the first and second opposing curved edges, and wherein the concave internal surface forms an inner surface of the reservoir.

4. The system of claim 1, wherein the first and second opposing curved edges are asymmetrical with respect to each other.

5. The system of claim 1, wherein the tip is offset from the longitudinal axis.

6. The system of claim 1, wherein the spatula further comprises a middle portion extending in the distal direction from the root, wherein the deformable portions comprise two side portions forming the first and second opposing curved edges along respective free edges of the two side portions and wherein each side portion is connected with the middle portion along a bound edge opposite the respective free edge, and wherein the middle portion and side portions form a C-shaped trough.

7. The system of claim 6, wherein the free edges have a curvilinear shape.

8. The system of claim 1, wherein the second opposing curved edge further comprises a third convex section adjoining the root at a proximal end thereof and adjoining the second concave section at a distal end thereof.

9. An applicator for applying a cosmetic, the applicator comprising:

a shaft having a longitudinal axis; and an applicator head connected with a distal end of the shaft and extending in the distal direction, wherein the applicator head comprises:

a root at a proximal end;

a scoop connected with the root and having a width transverse to the longitudinal axis; and a tip formed at a distal end of the scoop, wherein the scoop comprises a concave inner surface, a convex outer surface, and two opposing free edges extending from the root to the tip, wherein the scoop is formed from a flexible material, and wherein, when the scoop is drawn through an orifice with a diameter less than the width, the scoop flexes so that the free edges contact one another and the concave inner surface defines a reservoir, wherein the two opposing free edges comprise:

a first opposing curved edge comprising a first convex section adjoining the root and a first concave section continuous with, and distal of, the first convex section, and a second opposing curved edge comprising a second concave section and a second convex section continuous with, and distal of, the second concave section, wherein the tip is continuous with the first concave section and the second convex section.

10. The applicator of claim 9, wherein the second opposing curved edge further comprises a third convex section adjoining the root at a proximal end thereof and adjoining the second concave section at a distal end thereof.

11. An applicator for applying a cosmetic, the applicator comprising:

a shaft having a longitudinal axis; and an applicator head connected with a distal end of the shaft and extending in the distal direction, wherein the applicator head comprises:

a root at a proximal end;

a tip as a distal end;

a middle wall connected with the root and extending in distal direction from the root; and two opposing side walls, each side wall connected along one edge with the middle wall, each side wall extending substantially perpendicular from the middle wall, and having a free edge, wherein the middle wall and side walls forming a C-shaped trough, wherein the side walls extending traverse to the longitudinal axis and wherein the C-shape trough has a width transverse to the longitudinal axis;

wherein the C-shaped trough comprises a concave inner surface and a convex outer surface, wherein the side walls are formed from a flexible material, and wherein, when the applicator head is drawn through an orifice with a diameter less than the width, the side walls flex so that the free edges contact one another and the concave inner surface defines a reservoir wherein the free edge of a first of the two opposing side walls comprises a first opposing curved edge comprising a first convex section adjoining the root and a first concave section continuous with, and distal of, the first convex section, and wherein the free edge of a second of the two opposing side walls comprises a second opposing curved edge comprising a second concave section and a second convex section continuous with, and distal of, the second concave section, and wherein the tip is continuous with the first concave section and the second convex section and is formed at a distal ends of the first concave section and the second convex section.

12. The applicator of claim 11, wherein the second opposing curved edge further comprises a third convex section adjoining the root at a proximal end thereof and adjoining the second concave section at a distal end thereof.

* * * * *